US006791521B2

(12) United States Patent
Isami et al.

(10) Patent No.: US 6,791,521 B2
(45) Date of Patent: Sep. 14, 2004

(54) LIQUID CRYSTAL DISPLAY DEVICE HAVING A GRAY-SCALE VOLTAGE SELECTOR CIRCUIT

(75) Inventors: Hironobu Isami, Chiba (JP); Iwao Takemoto, Mobara (JP); Toshio Miyazawa, Chiba (JP); Katsumi Matsumoto, Mobara (JP)

(73) Assignees: Hitachi, Ltd., Tokyo (JP); Hitachi Device Engineering Co., Ltd., Tokyo (JP)

( * ) Notice: Subject to any disclaimer, the term of this patent is extended or adjusted under 35 U.S.C. 154(b) by 357 days.

(21) Appl. No.: 10/084,942

(22) Filed: Mar. 1, 2002

(65) Prior Publication Data

US 2002/0158828 A1 Oct. 31, 2002

(30) Foreign Application Priority Data

Mar. 5, 2001 (JP) ..... 2001-059394

(51) Int. Cl.[7] ..... G09G 3/36

(52) U.S. Cl. ..... 345/89; 345/90; 345/92; 345/98; 345/99; 345/100; 345/103; 345/690; 257/59; 386/65; 386/66; 349/7; 349/39; 349/42

(58) Field of Search ..... 345/89, 90, 92, 345/95, 98, 99, 100, 103, 690, 212, 213, 214; 257/59; 386/65, 66; 349/7, 39, 42

(56) References Cited

U.S. PATENT DOCUMENTS 5,953,002 A * 9/1999 Hirai et al. ..... 345/204
6,320,630 B1 * 11/2001 Yamashita et al. ..... 349/42
6,433,768 B1 * 8/2002 Miyazawa et al. ..... 345/98
6,512,506 B1 * 1/2003 Shimada ..... 345/99

* cited by examiner

*Primary Examiner*—Xiao Wu
*Assistant Examiner*—Abbas Abdulselam
(74) *Attorney, Agent, or Firm*—Antonellil, Terry, Stout & Kraus, LLP

(57) ABSTRACT

A liquid crystal display device has a circuit for selecting voltage levels based upon display data from an externally-supplied gray-scale voltage varying periodically. The circuit includes a plurality of series combinations of processing circuits. Each of the series combinations is associated with one of video signal lines coupled to pixels, and each of the processing circuits of a respective one of the plural series combinations is associated with a respective one of N display data lines for supplying the display data and with a respective one of plural time control signal lines for supplying time control signals varying in synchronism with the gray-scale voltage. Each of the processing circuits is disposed between two adjacent ones of the N display data lines. The time control signals uniquely determine one level of the gray-scale voltage in combination with the time control signals.

21 Claims, 25 Drawing Sheets

LIQUID CRYSTAL DISPLAY DEVICE HAVING A GRAY-SCALE VOLTAGE SELECTOR CIRCUIT

BACKGROUND OF THE INVENTION

This invention relates a liquid crystal display device, and more particularly to a technique useful for a circuit for supplying a video signal voltage to each pixel.

An active-matrix type liquid crystal display device having an active element for each pixel (for example, a thin film transistor) and switching the active elements has been used widely as a display device of a notebook personal computer or the like.

Among the active-matrix type liquid crystal display devices, a TFT (Thin Film Transistor) type liquid crystal display module has been known. In the TFT type liquid crystal display module, since a video signal voltage (a gray scale voltage) is applied to a pixel electrode via a thin film transistor (TFT), the TFT type liquid crystal display module is free from crosstalk between pixels, and therefore that the TFT type liquid crystal display module is capable of providing a multi-gray scale display without using a special driving method for preventing the crosstalk, unlike a simple matrix type liquid crystal display device.

However, when a D/A conversion which selects a gray-scale voltage corresponding to a display data in digital form is used for supplying the gray-scale voltage to a pixel electrode, problems arise that, as the number of gray scales increases, the number of bits representing a display data increases, and consequently, the scale of circuits becomes large and further the speed of operation of the circuits becomes insufficient. Further, especially in liquid crystal display devices of the driving-circuit-integrated type having driving circuits and a display section fabricated on the same substrate, the above problems are serious because they increase the area of the driving circuit section other than the useful display area.

There is a tendency for output signals from video equipment to be supplied in digital signals rather than in analog signals, and therefore there is a demand for a driving method for converting digital signals into multi-gray-scale video signal voltages by inputting digital signals into the liquid crystal display device and using a driving circuit fabricated on a liquid crystal display panel, in the liquid crystal display devices of the driving-circuit-integrated type also.

As a driving method for applying multi-gray-scale video signal voltages to each pixel so that a multi-gray-scale display can be produced by using digital signal input in the active matrix type liquid crystal display device, one method of driving is known which is disclosed in Japanese Patent Application Laid-open No. Hei 5-35200 (corresponding to U.S. Pat. No. 5,337,070).

In the method disclosed in Japanese Patent Application Laid-open No. Hei 5-35200, $2^m$ voltage bus lines are provided, and each of gray scale voltages provided from the $2^m$ voltage bus lines varies in a staircase fashion having $2^k$ steps during one horizontal scanning period corresponding to one horizontal scanning line.

One of the above-mentioned $2^m$ voltage bus lines is selected based on the high-order m bits of an n-bit display data, one of the voltage levels is selected based on the lower-order k (k=n−m) bits of the n-bit display data, from the gray scale voltage varying in the staircase fashion on the selected voltage bus line, and the selected voltage level is applied to a pixel electrode of a pixel.

For example, assume a case in which the display data is 3 bits (n=3), m=1, and k=2. Two voltage bus lines are provided and each voltage bus line is supplied with a gray scale voltage varying in a staircase fashion having four steps during one horizontal scanning period. A gray scale voltage on one of two voltage bus lines is selected based on the high-order 1 bit of the 3-bit display data, one voltage level is selected from the gray scale voltage varying in the staircase fashion having four steps on the selected voltage bus line, based on the lower-order 2 bits of the 3-bit display data, and the selected voltage level is applied to the pixel electrode of a pixel.

According to the driving method described in the above-mentioned Japanese Patent Application Laid-open No. Hei 5-35200, the operating speed of the circuit for applying a video signal voltage on each pixel can be reduced, variations in the video signal voltages caused by the D/A conversion are reduced over the entire display area, and the number of voltage bus lines can be reduced.

However, when the number of the gray-scale levels are increased to improve display quality, the scale of a selector circuit for selecting one of voltage levels varying in a staircase fashion is made larger, and an area occupied by the selector circuit becomes so large in incorporating it into the liquid crystal display panel, and consequently, a problem arises in that the liquid crystal display panel becomes large-sized. As a liquid crystal display device solving the above-problem, a technique for reducing the width of the selector circuit is known which is disclosed in Japanese Patent Application Laid-open No. 2000-194330.

SUMMARY OF THE INVENTION

Recently, in liquid crystal display devices, the number of gray-scale voltages has been increased further to 64 or 256. No consideration has given to a problem of an increase in length of the driving circuit for realizing 64 or more gray-scale levels in Japanese Patent Application Laid-open No. 2000-194330.

Further, in the liquid crystal display device, display resolution has been increasing, but no consideration has been given to reduction of an area where the driving circuit is fabricated, that is, that of an area occupied by the driving circuit, or the minimum required number of elements.

The present invention has been made to solve the above problems with the prior art, and provides a technique for reducing the scale of the driving circuit and thereby capable of reducing the area occupied by the circuit in the liquid crystal display device.

The above objects and novel features of the present invention will become more apparent by reference to the following detailed description taken in conjunction with the accompanying drawing.

The following explains the representative ones of the present inventions briefly.

In accordance with an embodiment of the present invention, there is provided a liquid crystal display device comprising a first substrate, a second substrate, a liquid crystal composition sandwiched between the first substrate and the second substrate, a plurality of pixels disposed on the first substrate, a plurality of video signal lines for supplying video signal voltages to the plurality of pixels, a drive circuit adapted to be supplied with a gray-scale voltage varying periodically for outputting the video signal voltages to the plurality of video signal lines, N display data lines for supplying display data to the drive circuit, and N time control signal lines for supplying time control signals varying in synchronism with the gray-scale voltage to the drive circuit, each of the N time control signals lines being associated with one of N bits representing the time control signals in a binary system; wherein the drive circuit is provided with a voltage selector circuit for selecting voltage levels from the gray-scale voltage based upon the display data and outputting the voltage levels to the plurality of video signal lines; the voltage selector circuit includes a plurality of series combinations of processing circuits, each of the plurality of series combinations being associated with one of the plurality of video signal lines, each of the processing circuits of a respective one of the plurality of series combinations being associated both with a respective one of the N display data lines and with a respective one of the N time control signal lines, and being disposed between two adjacent ones of the N display data lines, each of the processing circuits comprises a parallel combination of a display-data-related switching element and a time-control-signal-related switching element, the display data make $2^N$ different combinations by selecting a number of from zero to N of the display-data-related switching elements, assigning the selected number of the display-data-related switching elements to be turned OFF and turning ON the remainder of the display-data-related switching elements in each of the plurality of series combinations, each of the $2^N$ different combinations being uniquely in synchronism with one level of the gray-scale voltage, the time control signals uniquely determine one level of the gray-scale voltage by turning ON a time-control signal-related switching element constituting the parallel combination with the turned-OFF display-data-related switching element.

In accordance with another embodiment of the present invention, there is provided a liquid crystal display device comprising a first substrate, a second substrate, a liquid crystal composition sandwiched between the first substrate and the second substrate, a plurality of pixels arranged in a matrix array on the first substrate, a plurality of video signal lines extending in a column direction and arranged in a row direction of the matrix array for supplying video signal voltages to the plurality of pixels, a drive circuit adapted to be supplied with a gray-scale voltage varying periodically for outputting the video signal voltages to the plurality of video signal lines, N display data lines extending in the row direction and arranged in the column direction for supplying display data to the drive circuit, and N time control signal lines extending in the row direction and arranged in the column direction for supplying time control signals varying in synchronism with the gray-scale voltage to the drive circuit; wherein the drive circuit includes a voltage selector circuit for selecting voltage levels from the gray-scale voltage based upon the display data and outputting the voltage levels to the plurality of video signal lines, a shift register for supplying timing signals to the voltage selector circuit, and a plurality of timing signal lines for supplying the timing signals from the shift register to the voltage selector circuit; the voltage selector circuit includes a plurality of series combinations of processing circuits, and a plurality of data taking-in elements for taking in the display data in synchronism with the timing signals, each of the plurality of data taking-in elements corresponding to a respective one of the processing circuits and disposed together with the respective one of the processing circuits between two adjacent ones of the N display data lines, the plurality of timing signal lines are extending from the shift register in the column direction, connected to corresponding ones of the data taking-in elements, and are made of a conductive film of a same level as that of conductive films forming control electrodes of the data taking-in elements, each of the plurality of series combinations being associated with one of the plurality of video signal lines, each of the processing circuits of a respective one of the plurality of series combinations being associated both with a respective one of the N display data lines and a respective one of the N time control signal lines, each of the processing circuits comprises a parallel combination of a display-data-related switching element and a time-control-signal-related switching element, the display data make $2^N$ different combinations by selecting a number of from zero to N of the display-data-related switching elements, assigning the selected number of the display-data-related switching elements to be turned OFF and turning ON the remainder of the display-data-related switching elements in each of the plurality of series combinations, each of the $2^N$ different combinations being uniquely in synchronism with one level of the gray-scale voltage, the time control signals uniquely determine one level of the gray-scale voltage by turning ON a time-control-signal-related switching elements constituting the parallel combination with the turned-OFF display-data-related switching element.

In accordance with another embodiment of the present invention, there is provided a liquid crystal display device comprising a first substrate, a second substrate, a liquid crystal composition sandwiched between the first substrate and the second substrate, a plurality of pixels disposed on the first substrate, a plurality of video signal lines for supplying video signal voltages to the plurality of pixels, a drive circuit adapted to be supplied with a gray-scale voltage varying periodically for outputting the video signal voltages to the plurality of video signal lines, N display data lines for supplying display data to the drive circuit, and N time control signal lines for supplying time control signals varying in synchronism with the gray-scale voltage to the drive circuit; wherein the drive circuit is provided with a voltage selector circuit for selecting voltage levels from the gray-scale voltage based upon the display data and outputting the voltage levels to the plurality of video signal lines; the voltage selector circuit includes a plurality of series combinations of processing circuits, and a plurality of output circuits for outputting the voltage levels to the plurality of video signal lines based upon an output from the plurality of the series combinations, each of the plurality of output circuits being connected in series with a corresponding one of the plurality of series combinations, each of the plurality of series combinations being associated with one of the plurality of video signal lines, each of the processing circuits of a respective one of the plurality of series combinations being associated both with a respective one of the N display data lines and with a respective one of the N time control signal lines, and disposed between two adjacent ones of the N display data lines, each of the processing circuits comprises a parallel combination of a display-data-related switching element and a time-control-signal-related switching element coupled together to form an OR circuit, the display-data make $2^N$ different combinations by selecting a number of from zero to N of the display-data-related switching elements, assigning the selected number of the display-data-related switching elements to be turned OFF and turning ON the remainder of the display-data-related switching elements in each of the plurality of series combinations, each of the $2^N$ different combinations being uniquely in synchronized with one level of the gray-scale voltage, and each of the plurality of output circuits is supplied with a control signal for uniquely determining one level of the gray-scale voltage corresponding to the display data when all of the processing circuits of a corresponding one of the plurality of series combinations are turned ON.

In accordance with another embodiment of the present invention, there is provided a liquid crystal display device comprising a first substrate, a second substrate, a liquid crystal composition sandwiched between the first substrate and the second substrate, a plurality of pixels disposed on the first substrate, a plurality of video signal lines for supplying video signal voltages to the plurality of pixels, a drive circuit adapted to be supplied with a gray-scale voltage varying periodically for outputting the video signal voltages to the plurality of video signal lines, N display data lines for supplying display data to the drive circuit, and N time control signal lines for supplying time control signals varying in synchronism with the gray-scale voltage to the drive circuit, wherein the drive circuit is provided with a voltage selector circuit for selecting voltage levels from the gray-scale voltage based upon the display data and outputting the voltage levels to the plurality of video signal lines; the voltage selector circuit includes a plurality of series combinations of processing circuits, each of the plurality of series combinations being associated with one of the plurality of video signal lines, each of the processing circuits of a respective one of the plurality of series combinations being associated both with a respective one of the N display data lines and with a respective one of the N time control signal lines, and being disposed between two adjacent ones of the N display data lines, each of the processing circuits comprises a parallel combination of a display-data-related switching element and a time-control-signal-related switching element, the time control signals make $2^N$ different combinations by selecting a number of from zero to N of the time-control-signal-related switching elements, assigning the selected number of the time-control-signal-related switching elements to be turned OFF and turning ON the remainder of the time-control-signal-related switching elements in each of the plurality of series combinations, each of the $2^N$ different combinations being uniquely in synchronism with one level of the gray-scale voltage, the display data uniquely determine one level of the gray-scale voltage by turning ON a display-data-related switching element constituting the parallel combination with the turned-OFF time-control-signal-related switching element.

In accordance with another embodiment of the present invention, there is provided a liquid crystal display device comprising a first substrate, a second substrate, a liquid crystal composition sandwiched between the first substrate and the second substrate, a plurality of pixels arranged in a matrix array on the first substrate, a plurality of video signal lines extending in a column direction and arranged in a row direction of the matrix array for supplying video signal voltages to the plurality of pixels, a drive circuit adapted to be supplied with a gray-scale voltage varying periodically for outputting the video signal voltages to the plurality of video signal lines, N display data lines extending in the row direction and arranged in the column direction for supplying display data to the drive circuit, and N time control signal lines extending in the row direction and arranged in the column direction for supplying time control signals varying in synchronism with the gray-scale voltage to the drive circuit; wherein the drive circuit includes a voltage selector circuit for selecting voltage levels from the gray-scale voltage based upon the display data and outputting the voltage levels to the plurality of video signal lines, a shift register for supplying timing signals to the voltage selector circuit, and a plurality of timing signal lines for supplying the timing signals from the shift register to the voltage selector circuit; the voltage selector circuit includes a plurality of series combinations of processing circuits, and a plurality of data taking-in elements for taking in the video signal in synchronism with the timing signals, each of the plurality of data taking-in elements corresponding to a respective one of the processing circuits and disposed together with the respective one of the processing circuits between two adjacent ones of the N display data lines, the plurality of timing signal lines are extending from the shift register in the column direction, connected to corresponding ones of the data taking-in elements, and are made of a conductive film of a same level as that of conductive films forming control electrodes of the data taking-in elements, each of the plurality of series combinations being associated with one of the plurality of video signal lines, each of the processing circuits of a respective one of the plurality of series combinations being associated both with a respective one of the N display data lines and a respective one of the N time control signal lines, each of the processing circuits comprises a parallel combination of a display-data-related switching element and a time-control-signal-related switching element, the time control signals make $2^N$ different combinations by selecting a number of from zero to N of the time-control-signal-related switching elements, assigning the selected number of the time-control-signal-related switching elements to be turned OFF and turning ON the remainder of the time-control-signal-related switching elements in each of the plurality of series combinations, each of the $2^N$ different combinations being uniquely in synchronism with one level of the gray-scale voltage, the display data uniquely determine one level of the gray-scale voltage by turning ON a display-data-related switching elements constituting a parallel combination with the turned-OFF time-control-signal-related switching element.

In accordance with another embodiment of the present invention, there is provided 21. A liquid crystal display device comprising a first substrate, a second substrate, a liquid crystal composition sandwiched between the first substrate and the second substrate, a plurality of pixels disposed on the first substrate, a plurality of video signal lines for supplying video signal voltages to the plurality of pixels, a drive circuit adapted to be supplied with a gray-scale voltage varying periodically for outputting the video signal voltages to the plurality of video signal lines, N display data lines for supplying display data to the drive circuit, and N time control signal lines for supplying time control signals varying in synchronism with the gray-scale voltage to the drive circuit; wherein the drive circuit is provided with a voltage selector circuit for selecting voltage levels from the gray-scale voltage based upon the display data and outputting the voltage levels to the plurality of video signal lines; the voltage selector circuit includes a plurality of series combinations of processing circuits, and a plurality of output circuits for outputting the voltage levels to the plurality of video signal lines based upon an output from the plurality of the series combinations, each of the plurality of output circuits being connected in series with a corresponding one of the plurality of series combinations, each of the plurality of series combinations being associated with one of the plurality of video signal lines, each of the processing circuits of a respective one of the plurality of series combinations being associated both with a respective one of the N display data lines and with a respective one of the N time control signal lines, and disposed between two adjacent ones of the N display data lines, each of the processing circuits comprises a parallel combination of a display-data-related switching element and a time-control-signal-related switching element coupled together to form an OR circuit, the time control signals make $2^N$ different combinations by selecting a number of from zero to N of the time-control-signal-related switching elements, assigning the selected number of the time-control-signal-related switching elements to be turned OFF and turning ON the remainder of the time-control-signal-related switching elements in each of the plurality of series combinations, each of the $2^N$ different combinations being uniquely in synchronized with one level of the gray-scale voltage, and each of the plurality of output circuits is supplied with a control for uniquely determining one level of the gray-scale voltage corresponding to the display date when all of the processing circuits of a corresponding one of the plurality of series combinations are turned ON.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

Figure 1:
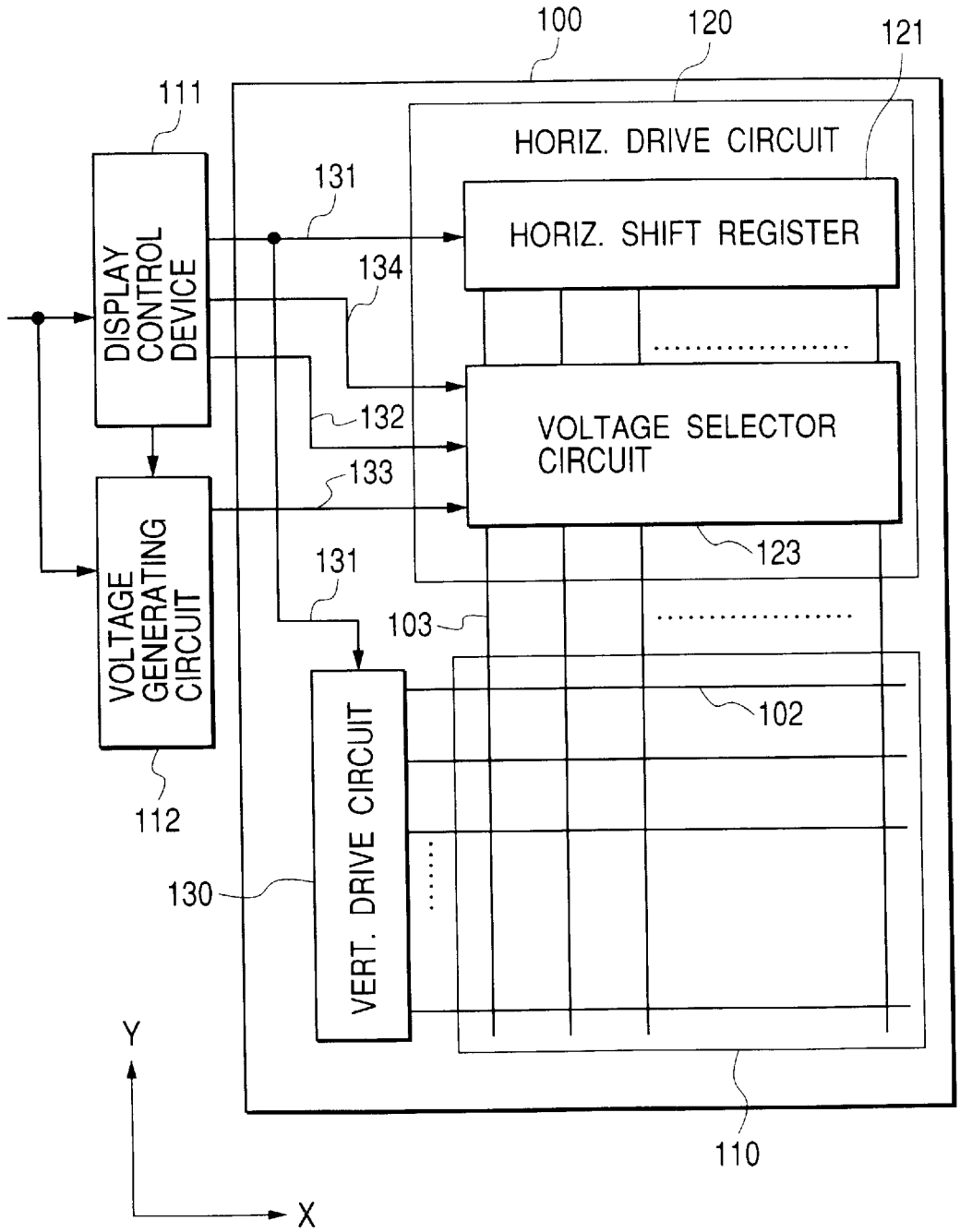
FIG. 1 is a block diagram illustrating a schematic overall configuration of an embodiment of the liquid crystal display device in accordance with the present invention.

The following describes the embodiments in accordance with the present invention in detail by reference to the drawings. Same reference numerals designate functionally similar parts throughout the figures for explaining the embodiments of the present invention, and they are not repeatedly explained.

FIG. 1 is a block diagram for illustrating a rough overall structure of a liquid crystal display module in accordance with an embodiment of the present invention. The liquid crystal display module of the present embodiment comprises a liquid crystal display panel (a liquid crystal display element) 100, a display control device 111, and a voltage generating circuit 112.

The liquid crystal display panel 100 comprises a display section 110, a horizontal drive circuit (a video signal line drive circuit) 120, and a vertical drive circuit (a scanning signal line drive circuit) 130. The display section 110, the horizontal drive circuit 120, and the vertical drive circuit 130 are disposed on the same substrate. The display control device 111 and the voltage generating circuit 112 are illustrated as separate from the liquid crystal display panel 100, but they can be disposed on the same substrate on which the liquid crystal display panel 100 is disposed.

The display control device 111 controls the horizontal drive circuit 120 and the vertical drive circuit 130, based upon control signals such as clock signals, a display timing signal, a horizontal sync signal, a vertical sync signal, which are externally transmitted. The display control device 111 supplies display data which are image data to be displayed on the liquid crystal display panel 100, to the horizontal drive circuit 120. The voltage generating circuit 112 generates voltages necessary for the liquid crystal display panel 100 to produce a display. The horizontal drive circuit 120 selects and outputs to the display section 110 gray-scale voltages supplied from the voltage generating circuit 112 in accordance with display data, and the display section 110 inputs the gray-scale voltages into pixels (not shown) in synchronism with a scanning signal output from the vertical drive circuit 130.

A plurality of video signal lines (also called drain signal lines or vertical signal lines) 103 extend from the horizontal drive circuit 120 in a vertical direction (in the Y direction in FIG. 1) into the display section 110, and they are arranged in a horizontal direction (in the X direction in FIG. 1). The gray-scale voltages are supplied to the display section 110 via the video signal lines 103. A plurality of scanning signal lines (also called gate signal lines or horizontal signal lines) 102 extend from the vertical drive circuit 130 in the horizontal direction (in the X direction in FIG. 1) into the display section 110, and they are arranged in the vertical direction (in the Y direction in FIG. 1). The scanning signals are supplied to the display section 110 via the scanning signal lines 102.

The horizontal drive circuit 120 comprises a horizontal shift register 121 and a voltage selector circuit 123. A timing control signal line 131 from the display control device 111 is connected to the horizontal shift register 121 and the vertical drive circuit 130, and a display data line 132 and a time control signal line 134 from the display control device 111 are connected to the voltage selector circuit 123. A gray-scale voltage line 133 from the voltage generating circuit 112 is connected to the voltage selector circuit 123 to supply gray-scale voltages thereto. For simplicity, voltage supply lines to the respective circuits are omitted from FIG. 1, but it is to be understood that necessary supply voltages are provided to the respective circuits.

The display control device 111 acknowledges the first display timing signal immediately after a vertical sync signal as corresponding to the first; display line, and outputs a start pulse which is one of timing control signals to the vertical drive circuit 130 via the timing control signal line 131. The display control device 111 outputs shift clocks to the vertical drive circuit 130 with a horizontal scanning period based upon the horizontal sync pulses so that the scanning signal lines 102 are selected sequentially. The vertical drive circuit 130 selects the scanning signal lines 102 based upon the shift clocks and supplies the scanning signals to the selected scanning signal lines 102.

Further, when the display control device 111 receives a display timing signal, the display control device 111 acknowledges the display timing signal as corresponding to a display start, and outputs display data to the horizontal drive circuit 120. Display data are output sequentially from the display control device 111, and the horizontal shift register 121 outputs timing signals used for selecting display data to be supplied to the respective video signal lines 103, to the voltage selector circuit 123, based upon the shift clocks which are one of the timing control signals transmitted from the display control device 111.

The voltage selector circuit 123 takes in the display data in accordance with the timing signals, selects one of the gray-scale voltages supplied by the voltage generating circuit 112 corresponding to each of the display data, and outputs the selected voltages to the video signal lines 103. The voltage selector circuit 123 will be explained in detail subsequently.

Figure 2:
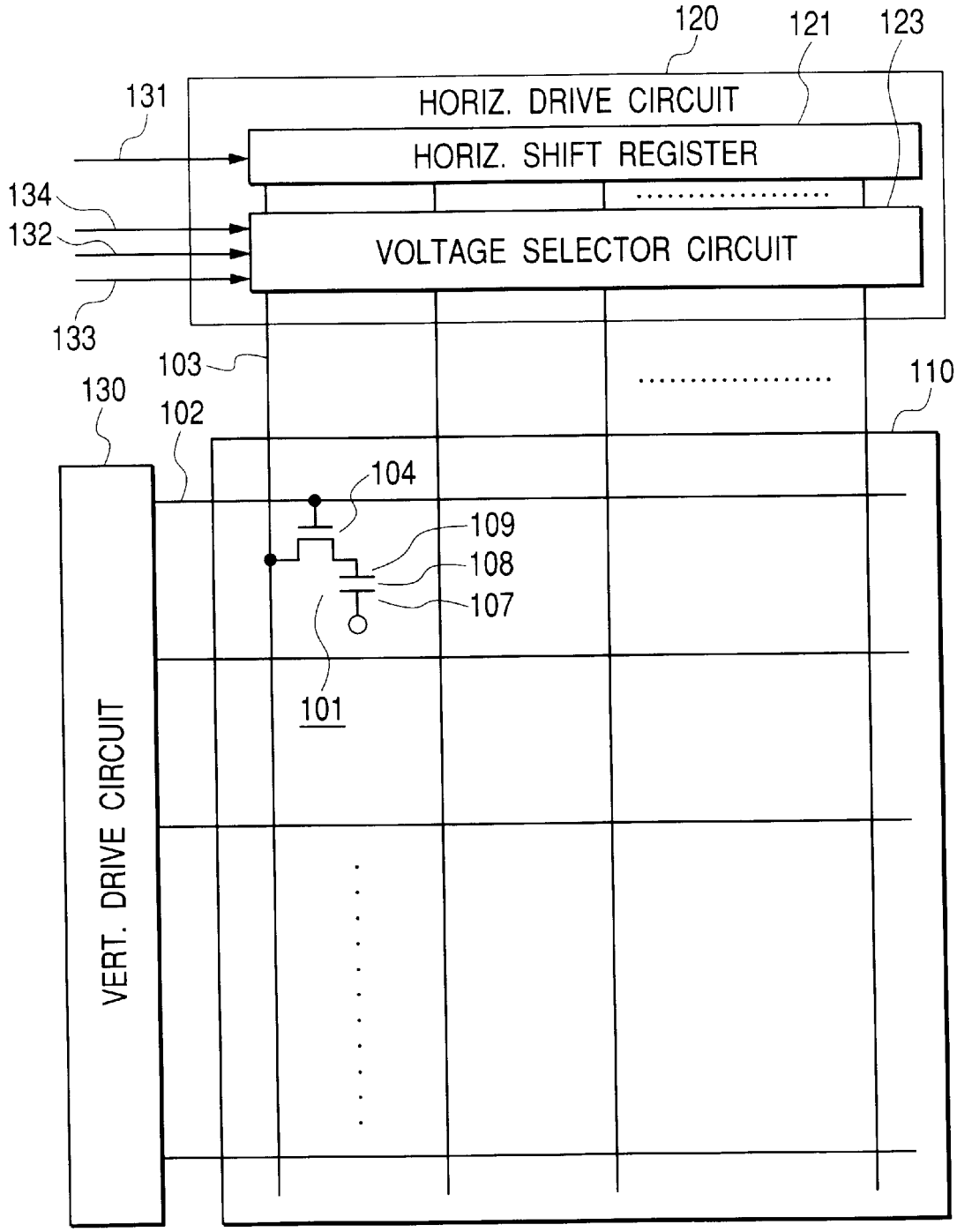
FIG. 2 is an equivalent circuit diagram of a liquid crystal display panel of the liquid crystal display device in accordance with an embodiment of the present invention.

FIG. 2 illustrates an equivalent circuit of a liquid crystal display panel 100 in accordance with an embodiment of the present invention. The circuit diagram illustrated in FIG. 2 also represents an actual geometrical arrangement of its circuit components. The display section 110 has pixel sections 101 arranged in a matrix fashion. For simplicity, only one pixel section is depicted in FIG. 2. Each pixel 101 has a switching element 104 and a pixel electrode 109, and is disposed in an area surrounded by two adjacent ones of the scanning signal lines 102 and two adjacent ones of the video signal lines 103.

As described above, the vertical drive circuit 130 outputs the scanning signals sequentially to the scanning signal lines 102 with one horizontal scanning period, and the scanning signals are used for on-or-off control of the switching elements 104.

The video signal lines 103 are supplied with the gray-scale voltages, and when the switching elements 104 are turned on, the gray-scale voltages are supplied to the pixel electrodes 109 from the video signal lines 103. A counter electrode (a common electrode) 107 is disposed to face the pixel electrodes 109, and a liquid crystal layer (not shown) is interposed between the pixel electrodes 109 and the counter electrode 107. In the circuit diagram shown in FIG. 2, an equivalent liquid crystal capacitance 108 due to the liquid crystal layer is illustrated as connected between one of the pixel electrode 109 and the counter electrode 107.

A display is produced by applying voltages between the pixel electrodes 109 and the counter electrode 107 and thereby changing optical properties of the liquid crystal layer. The gray-scale levels of the respective pixels forming an image displayed on the liquid crystal display panel depend upon the voltages supplied to the pixel electrodes 109. Therefore, the number of the gray-scale voltage levels to be supplied to the pixel electrodes 109 increases as the number of the gray-scale levels to be displayed on the liquid crystal display panel is increased.

In the display section 110, brightness of the display section 110 is determined by the ratio of an area occupied by the pixel electrodes 109 to the overall area of the display section 110, and therefore the size of the pixel electrodes 109 of the pixel section 101 is fabricated to be as large as possible. In other words, in the liquid crystal display panel, the area occupied by portions other than the pixel electrodes 109 are designed to be as small as possible.

As described above, the gray-scale voltages supplied to the pixel electrodes 109 are output from the voltage selector circuit 123. When the number of the gray-scale levels to be displayed on the liquid crystal display panel 100, the voltage selector circuit 123 has to select gray-scale voltages desired to be output to the video signal lines 103 among a large number of gray-scale voltage levels, and the amount of data increases which is transmitted via the display data lines 132 connected between the display control device 111 and the voltage selector circuit 123. Consequently, when the number of gray-scale levels to be displayed on the liquid crystal display panel 100, a problem arises in that the number of the display data lines 132 is increased, and as a result the scale of the voltage selector circuit 123 is made larger. In the present invention, the voltage selector circuit 123 is formed of a circuit configuration made as small as possible, and is arranged efficiently in the liquid crystal display panel 100.

Further, especially in liquid crystal display devices of the so-called driving-circuit-integrated type having the driving circuits and the display section fabricated on the same substrate, the present invention solves problems with small-sized liquid crystal display devices having the number of gray-scale levels increased.

Figure 3:
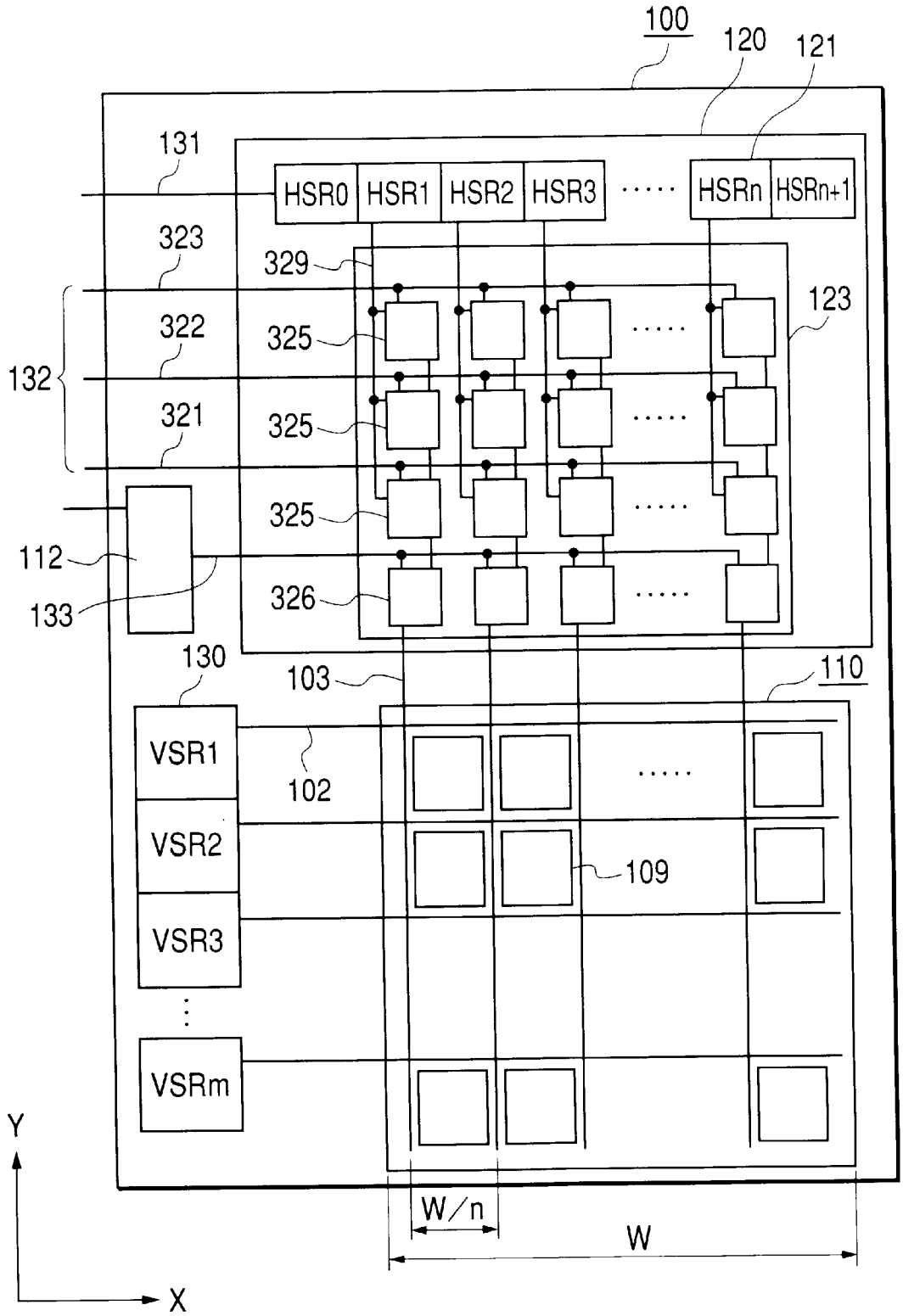
FIG. 3 is a block diagram for explaining a rough configuration of a horizontal drive circuit and a display section of the liquid crystal display device in accordance with an embodiment of the present invention.

The following explains the voltage selector circuit 123 by reference to FIG. 3. FIG. 3 is a block diagram for explaining a relationship between a width of an internal circuit of the voltage selector circuit 123 and a center-to-center spacing between two adjacent ones of the video signal lines 103. The voltage selector circuit 123 includes display data processing circuits 325 and gray-scale voltage output circuits 326. Each of the display data processing circuits 325 and the gray-scale voltage output circuits 326 is arranged on an extension line of a corresponding one of the video signal lines 103.

Display data lines 321–323 from the display control device 111 (not shown) are connected to the horizontal drive circuit 120. Each of the display data lines 321–323 corresponds to one bit of the display data in digital form when the display data explained in connection with FIGS. 1 and 2 are in digital representation. The display data lines 321–323 represent respective ones of the display data line 132 indicated in FIGS. 1 and 2 corresponding one bit. The time control signal lines 134 from the display control device 111 are connected to the voltage selector circuit 123, but they are omitted in FIG. 3.

Display data are sequentially output to the display data lines 321–323, and the horizontal shift register 121 outputs timing signals with which the display data are taken in synchronism. Timing signal lines 329 from the horizontal shift register 121 are connected to the voltage selector circuit 123, and they transmit timing signals to the voltage selector circuit 123. Reference characters HSR1 to HSRn denote bidirectional shift registers. The horizontal shift register 121 comprises the bidirectional shift registers HSR1 to HSRn. The bidirectional shift registers HSR1 to HSRn output timing signals based upon signals (shift clocks) from the timing control signal line 131.

Display data intended for each of the video signal lines 103 are output to the display data signal lines 321–323, and the display data processing circuits 325 take in the display data in synchronism with a corresponding one of the timing signals. The bidirectional shift registers HSR0 and HSRn+1 are dummy.

In FIG. 3, the voltage generating circuit 112 is disposed on one of the substrates forming the liquid crystal display panel 100, and the gray-scale voltage line 133 from the voltage generating circuit 112 is connected to the gray-scale voltage output circuit 326. A number n of video signal lines 103 are arranged at approximately equal intervals in the display section 110. A spacing between adjacent ones of the video signal lines 103 is approximately equal to the width of the pixel electrode 109 disposed in the display section 110. The number of the pixels to be provided in a given area of the display section 110 is determined by the related standards. Therefore, the area of the display section 110 and the number of the pixels determine the size of the area where one pixel is fabricated. The spacing between two adjacent ones of the video signal lines 103 is selected based upon the size of the area where one pixel is formed. For example, suppose that a number n of pixels are arranged in a horizontal direction (in the X direction) in the display section 110 in FIG. 3, and the width of the display section 110 is W. Then the pitch of the arrangement of the pixels is W/n, and the center-to-center spacing between the video signal lines 103 is approximately equal to the pixel pitch W/n. The widths of the display data processing circuits 325 and the gray-scale voltage output circuits 326 arranged on the extension line of the video signal lines 103 are approximately equal to the pixel pitch W/n.

On the extension line of each of the video signal lines 103 are provided the display data processing circuits 325 and the gray-scale voltage output circuit 326 for outputting gray-scale voltages to a corresponding one of the video signal lines 103. Combinations of the display data processing circuits 325 and the gray-scale voltage output circuit 326 are also disposed on two extension lines adjacent to an arbitrary one of the extension lines of the video signal lines 103. Therefore, if the widths of the display data processing circuits 325 and the gray-scale voltage output circuits 326 are not restricted within the horizontal pixel pitch, a problem arises in that the display data processing circuits 325 or the gray-scale voltage output circuits 326 overlap an adjacent one of the display data processing circuits 325 and the gray-scale voltage output circuits 326. Therefore, in a case where the area of the display section is reduced, or the number of pixels is increased, a problem arises in that consideration has to be given to the width of the circuits so that the driving circuits can be formed within the pixel pitch.

In the present embodiment, in order to arrange the display data processing circuit 325 and the gray-scale voltage output circuit 326 efficiently within the horizontal pixel pitch, a plurality of the display data processing circuits 325 are provided, each of which corresponds to a corresponding one of the display data lines 321–323, they are arranged in conformity with the arrangement of the display data lines 321–323, and they are disposed on an extension line of a corresponding one of the video signal lines 103.

As shown in FIG. 3, the display data lines 321–323 extend from the display control device 111, and are connected to the display data processing circuit 325. This embodiment explains a case where three-bit display data representing eight gray-scale levels is used, and the number of the display data lines 321–323 is three. In the present embodiment, for simplicity, a case will be described where the number of the display data lines is three, but it is possible to select an arbitrary number of the display data lines depending upon display data.

The display data processing circuits 325 are provided each of which is associated with a corresponding one of the display data lines 321–323, performs digital processing using a corresponding bit of the display signal, and then transmits a processing result to the gray-scale voltage output circuit 326. The gray-scale voltage output circuit 326 outputs a gray-scale voltage corresponding to the display data based upon the processing results from the display data processing circuit 325.

As described above, the spacing between the video signal lines 103 is limited by the size of the pixel electrodes 109 disposed in the display section 110. On the other hand, the spacing between two adjacent ones of the display lines 321–323 can be selected to wide enough for each of the display data processing circuit 325 to be disposed therebetween. As shown in FIG. 3, three display data processing circuits 325 associated with one of the video display lines 103 are arranged in a line on the extension line of the one of the video display lines 103 (in the Y direction in FIG. 3), and each of the three display data processing circuits 325 is also arranged in the vicinity of a corresponding one of the display data lines 321–323. Consequently, the display data processing circuits 325 can be disposed within the two adjacent ones of the video display lines 103.

However, the present inventors have found out that the spacing between the display data lines cannot be made large freely, but it is necessary to make the spacing as small as possible. Reduction of the length as well as the width of the display data processing circuits 325 will be described subsequently.

Figure 4:
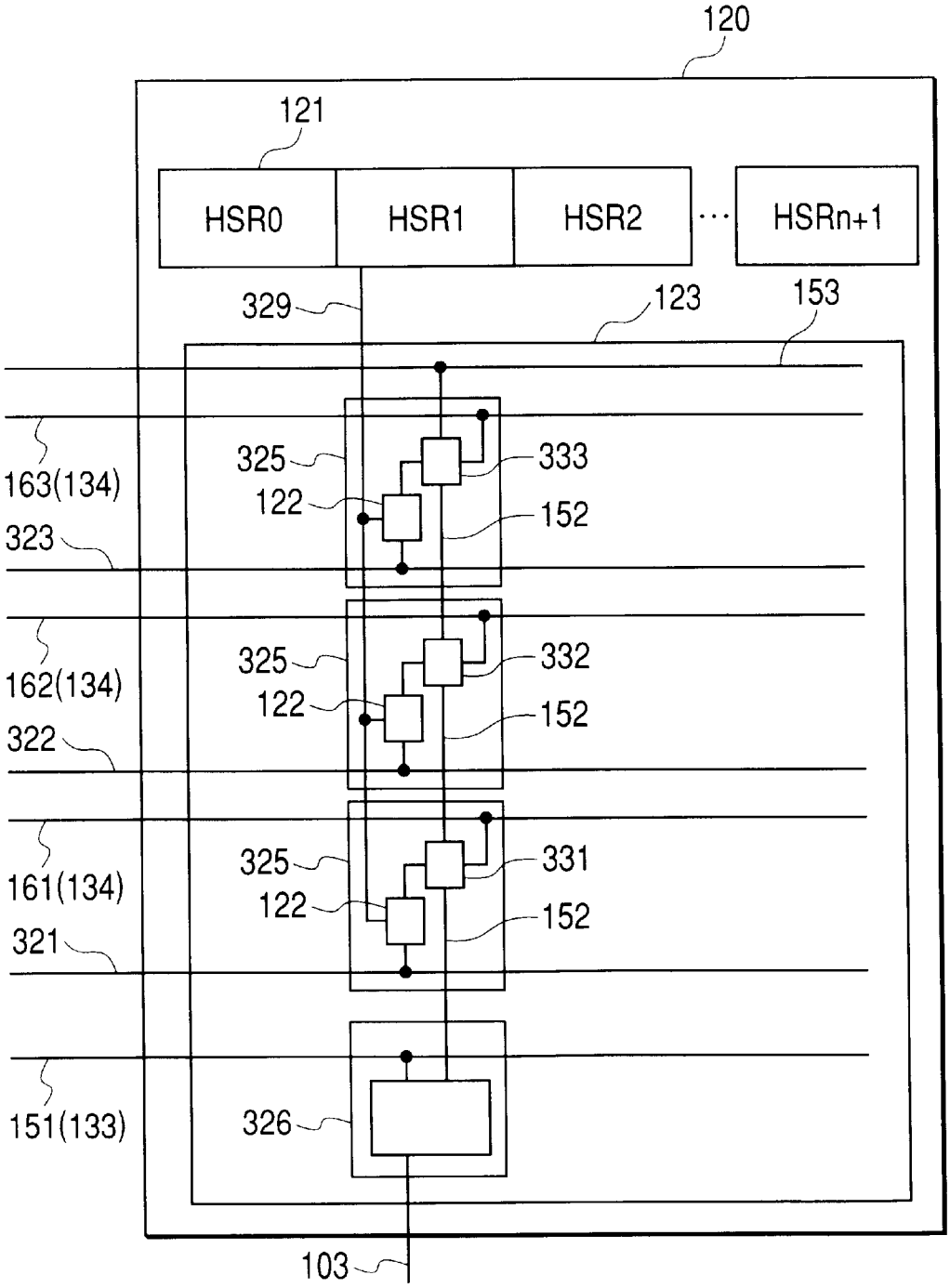
FIG. 4 is a block diagram for explaining a rough configuration of a horizontal drive circuit of the liquid crystal display device in accordance with an embodiment of the present invention.

The voltage selector circuit 123 will now be explained in detail by reference to FIG. 4. FIG. 4 is a rough block diagram illustrating a circuit configuration of the voltage selector circuit 123. In FIG. 4, only the configuration of the voltage selector circuit 123 associated with one of the video signal lines 103 are shown to avoid complication of the figure.

As described above, the voltage selector circuit 123 is provided with the display data processing circuits 325 each of which is associated with a corresponding one of the display data lines 312–323. Each of the display data processing circuits 325 is connected to a corresponding one of time control signal lines 161–163.

The time control signal lines 161–163 are included in the control signal lines 134 indicated in FIGS. 1 and 2, and are connected to the display control device 111 (not shown in FIG. 4).

In FIG. 4, reference numeral 122 denote display data hold circuits, which store display data from the display data lines 321–323, respectively, in synchronism with a signal supplied by the horizontal shift register 121 via the timing signal line 329. Reference numerals 331, 332 and 333 denote processing-result transmitting circuits, each of which performs digital processing by using outputs from the display data hold circuits 122 and a signal from a corresponding one of the time control signal lines 161–163, and outputs its processing result to a processing-result signal line 152. The processing-result transmitting circuits 331–333 are connected in series by the processing-result signal line 152. The gray-scale voltage output circuit 326 is also connected in series with the processing-result transmitting circuits 331–333 by the processing-result signal lines 152. The gray-scale voltage output circuit 326 selects one of gray-scale voltages on a voltage bus line 151 in accordance with a processing result transmitted by the processing-result transmitting circuits 331–333 and outputs it to the video signal line 103. The voltage bus line 151 is the gray-scale line 133 indicated in FIGS. 1 to 3 in a case where a time-varying voltage is carried on the gray-scale line. In FIG. 4, only one voltage bus line is provided, but a plurality of voltage bus lines can be also utilized.

In the present embodiment, the processing-result transmitting circuits 331–333 and the gray-scale voltage output circuit 326 are connected by a smaller number of processing-result signal lines 152 than the number of the display data lines, and therefore a area required for wiring can be reduced. To put it concretely, the data transmitted by the three display data lines 321–323 are processed by the three the processing-result transmitting circuits 331–333, then their processing results are transferred in the vertical direction via a single processing-result signal line 152, and therefore the number of wirings is reduced. Further, the three processing-result transmitting circuits 331–333 are arranged in the vertical direction, and as a result the width of the circuit configuration for outputting gray-scale voltages to the video signal line 103 can be reduced.

The following explains a method which selects a gray-scale voltage and outputs to the video signal line 103 by using the gray-scale voltage output circuit 326. The gray-scale voltage output circuit 326 has the voltage bus line 151 connected thereto. A voltage on the voltage bus line 151 varies periodically with time. When the time-varying voltage on the voltage bus line 151 becomes a desired voltage value, the gray-scale voltage output circuit 326 electrically connects the voltage bus line 151 to the video signal line 103, but when the time-varying voltage on the voltage bus line 151 is not equal to the desired voltage value, the gray-scale voltage output circuit 326 disconnect the voltage bus line 151 from the video signal line 103, so that the desired voltage can be output as a gray-scale voltage to the video signal line 103.

The following explains the operation of the voltage selector circuit 123 briefly. Initially display data are stored in the display data hold circuits 122 in synchronism with a timing signal output from the horizontal shift register 121. Then the display data stored in the display data hold circuits 122 are transmitted to the processing-result transmitting circuits 331–333. Time control signals on the time control signal lines 161–163 vary with time, and the processing-result transmitting circuits 331–333 perform digital processing by using the values from the display data hold circuits 122 and the values of the time control signals on the time control signal lines 161–163. The processing results obtained by the processing-result transmitting circuits 331–333 are transmitted to the gray-scale voltage output circuit 326. When the voltage on the voltage bus line 151 becomes equal to a gray-scale voltage represented by the display data, the processing results obtained by the processing-result transmitting circuits 331–333 are output and thereby the gray-scale voltage output circuit 326 outputs the gray-scale voltage from the voltage bus line 151, to the video signal line 103.

Referring again to FIG. 4, the following explains a method in which the processing-result transmitting circuits 331–333 are composed of switching circuits, a voltage from a fixed-voltage line 153 is output to the processing-result signal line 152, and then is transmitted to the gray-scale voltage output circuit 326 so that the gray-scale voltage output circuit 326 can output a desired gray-scale voltage.

Since the three processing-result transmitting circuits 331–333 are connected in series by the processing-result signal line 152, the states represented by the processing-result transmitting circuits 331–333 are the following two states only:

(i) all of the processing-result transmitting circuits 331–333 are turned ON, and as a result the voltage on the fixed-voltage line 153 is transmitted to the gray-scale voltage output circuit 326;

(ii) at least one of the processing-result transmitting circuits 331–333 is turned OFF, and as a result the voltage on the fixed-voltage line 153 is not transmitted to the gray-scale voltage output circuit 326.

If the number of states transmitted to the gray-scale voltage output circuit 326 is only two, it is difficult for the gray-scale voltage output circuit 326 to output a plurality of gray-scale voltages.

To solve this problem, in the present embodiment, the display data processing circuits 325 are configured such that a certain number of processing-result transmitting circuit are selected from a number m (three in this embodiment) of the processing-result transmitting circuits (331–333) so as to serve as switching circuits. With this configuration, the number m of the processing-result transmitting circuits (331–333) can represent a number $2^m$ of states even if they are connected in series by the processing-result signal line 152.

TABLE 1 shows variations of assignments of the three processing-result transmitting circuits 331, 332 and 333 for switching circuits.

TABLE 1

| Processing-result transmitting cicuits | Case 1 | Case 2 | Case 3 | Case 4 | Case 5 | Case 6 | Case 7 | Case 8 |
|---|---|---|---|---|---|---|---|---|
| 333 | — | — | — | — | SW | SW | SW | SW |
| 332 | — | — | SW | SW | — | — | SW | SW |
| 331 | — | SW | — | SW | — | SW | — | SW |

In Table 1, "-" indicates that a processing-result transmitting circuit is ON (conducting) at all times, and "SW" indicates that a processing-result transmitting circuit serves as a switching circuit. Although the three processing-result transmitting circuits 331, 332 and 333 are configured as switching circuits, if the processing-result transmitting circuits are set to be ON at all times, the switching circuits can be considered absent and conducting.

As described above, in a case where the switching circuits are connected in series, only two states can be selected, one is that all the switching circuits are ON, and the other one is that at least one of the switching circuits is OFF. However, if, as shown in TABLE 1, a number m (three in TABLE 1) of the switching circuits (the processing-result transmitting circuits 331–333) are configured such that, in each case, only a certain number of switching circuits can be selected from the number m of the switching circuits for switching operation, a number $2^m$ of different states can be selected.

When a repetition period is divided into $2^m$ intervals, and different combinations of data time-varying with the period from a plurality of the time control signal lines (161–163) at respective ones of the $2^m$ intervals is configured so as to represent a number $2^m$ of different states, all of the processing-result transmitting circuits (331–333) can be made conducting, and thereby the voltage on the fixed-voltage line 153 can be transmitted to the gray-scale voltage output circuit 326 during one of the $2^m$ intervals corresponding to display data, based upon the data from the time control signal lines (161–163) and the display data.

Figure 5:
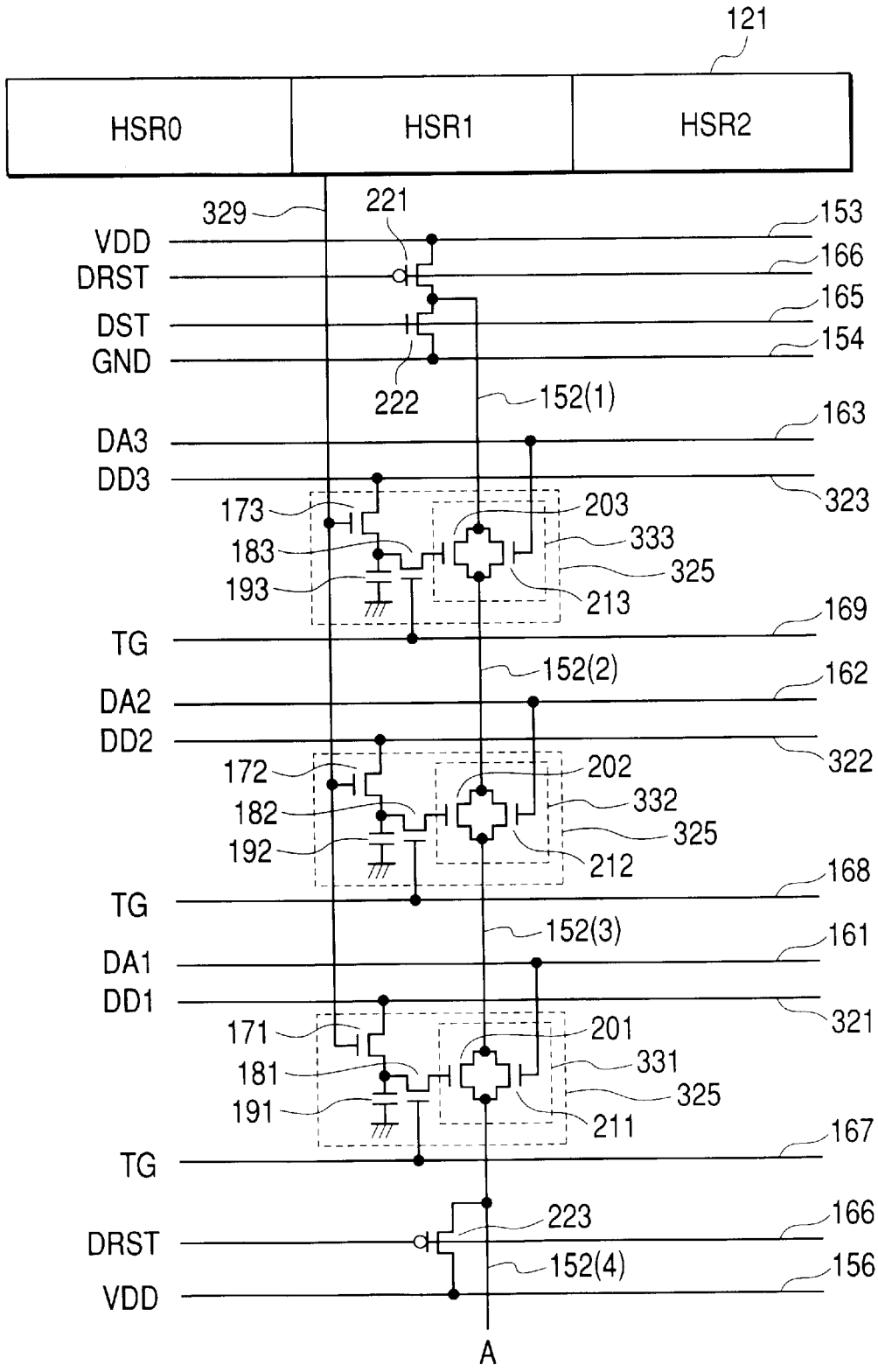
FIG. 5 is a circuit diagram for explaining a rough configuration of a voltage selector circuit of the liquid crystal display device in accordance with an embodiment of the present invention.
Figure 6:
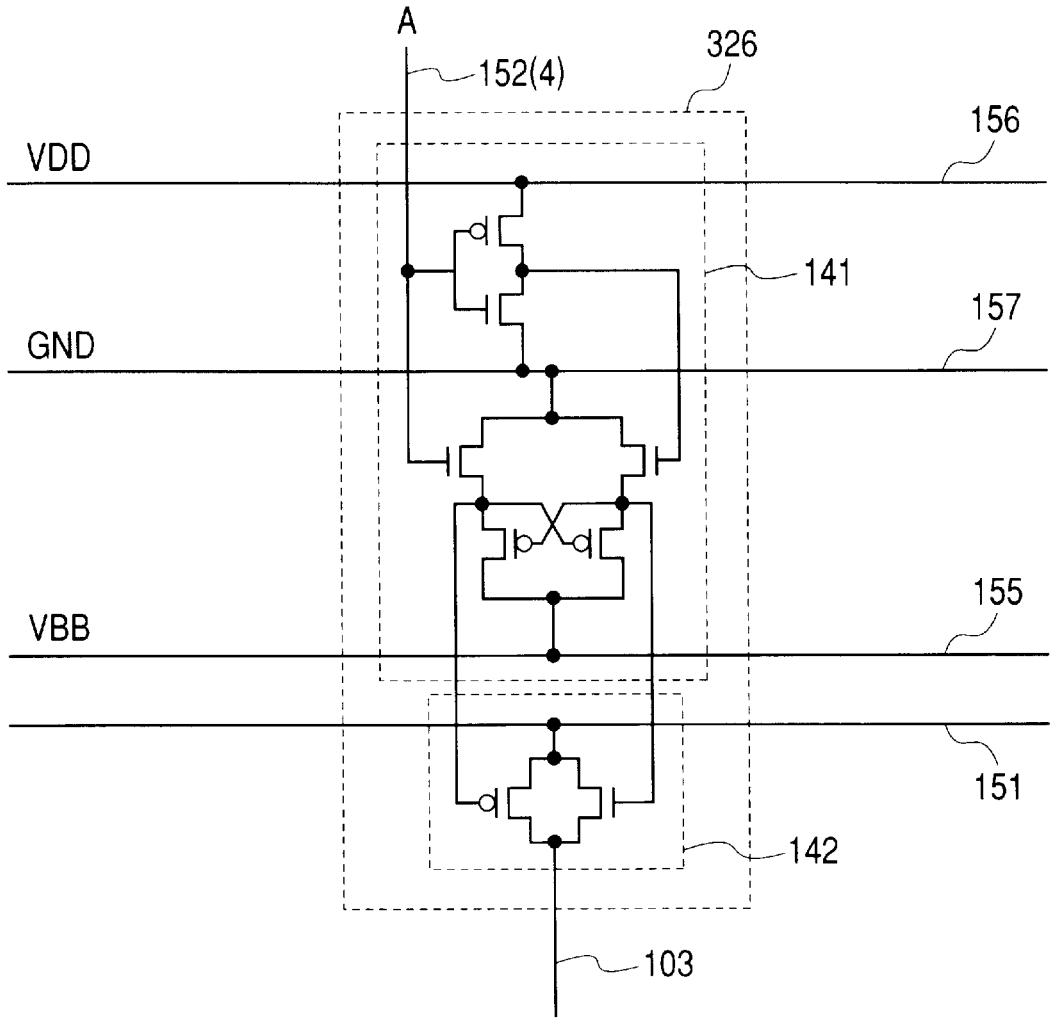
FIG. 6 is a circuit diagram for explaining a rough configuration of a voltage selector circuit of the liquid crystal display device in accordance with an embodiment of the present invention.

FIGS. 5 and 6 are circuit diagrams illustrating first and second parts of a circuit configuration of the voltage selector circuit 123 in the present embodiment, respectively, and a line end designated A in FIG. 5 is connected to that designated A in FIG. 6. In FIGS. 5 and 6 also, for simplicity, shown is a case in which display data is composed of three bits. In FIG. 5, some of signal lines have added references characters denoting signals transmitted thereto at their left-hand ends and reference numerals assigned thereto at their right-hand ends.

As shown in FIG. 5, each of the processing-result transmitting circuits 331–333 in FIG. 4 is composed of two n-type transistors, one of which serves as display data processing elements 201–203 and the other of which serves as time data processing elements 211–213, respectively.

Each of the display data processing circuits 325 of FIG. 4 includes data taking-in elements 171–173, memory capacitances 191–193, and display data transfer elements 181–183, in addition to the display data processing elements 201–203 and the time data processing elements 211–213, respectively. The display data processing circuits 325 are connected to the display data lines 321–323 for supplying display data DD1–DD3, to the time control signal lines 161–163 for supplying time control signals DA1–DA3, and to transfer signal lines 167–169 for supplying a transfer signal TG for controlling the display data transfer elements 181–183, respectively.

The display data held in the memory capacitances 191–193 are transferred to the display data processing elements 201–203 via the display data transfer elements 181–183 in accordance with the transfer signal TG. Reference numerals 153 and 156 denote fixed-voltage lines for supplying a supply voltage VDD. Reference numeral 154 denotes a fixed-voltage line for supplying a supply voltage GND. Reference numeral 166 is the processing-result-signal-line set signal line, and 166 is a processing-result-signal-line reset signal line. In FIG. 6, reference numeral 141 denotes a level shift circuit, 142 is a gate circuit, and 151 is the voltage bus line.

As shown in FIG. 5, when one of the display data processing circuits 325 is provided for each of the display data lines 321–323, and is composed of transistors of the same conductivity type only, the length as well as the width of area occupied by the voltage selector circuits 123 can be reduced in a liquid crystal display device.

First, before explaining the circuit of FIG. 5 in detail, the size of an area required for fabricating elements of the circuits such as the display data processing circuit 325 will be explained by reference to FIGS. 7A, 7B, 8A–8C and 9A–9B.

Figure 7B:
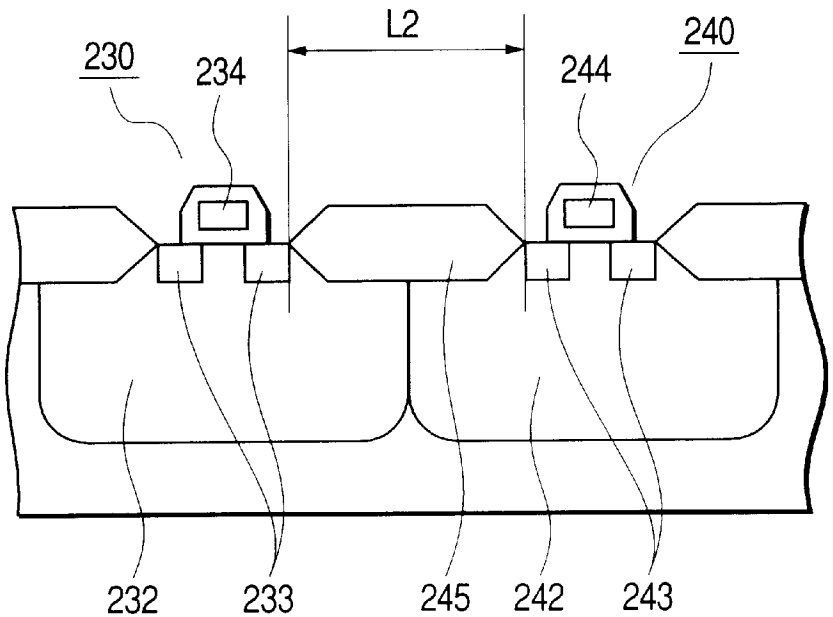
FIG. 7B PRIOR ART
FIGS. 7A and 7B are schematic cross-sectional views of two different conventional structures in which two transistors are fabricated side by side.
Figure 7A:
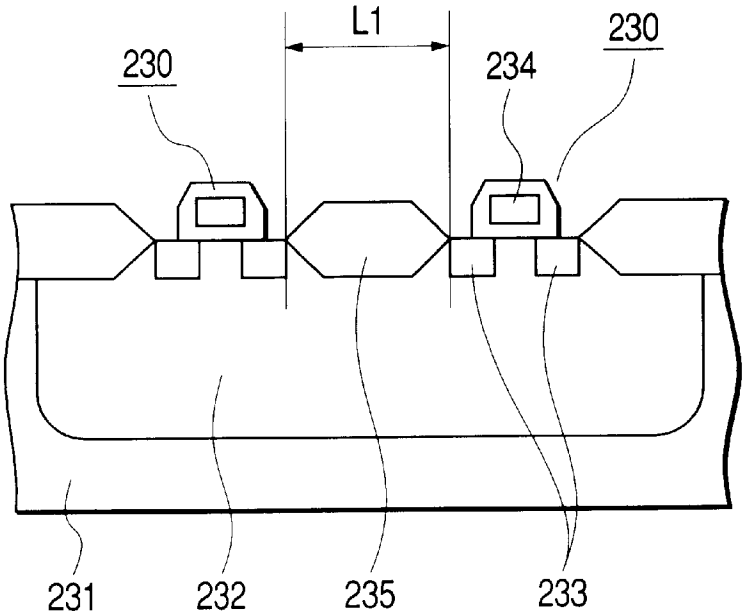
FIG. 7A PRIOR ART

FIGS. 7A and 7B are schematic cross-sectional views of structures in which two transistors are fabricated side by side. FIGS. 7A and 7B illustrate conventional structures of general transistors. FIG. 7A depicts a case in which two transistors of the same conductivity type are fabricated side by side, and two n-type transistors 230 are arranged side by side. FIG. 7B depicts a case in which two transistors of opposite conductivity types are fabricated side by side, on the left-hand side is an n-type transistor 230, and on the right-hand side is a p-type transistor 240.

In FIG. 7A, reference numeral 232 denotes a p-type well, which is fabricated in a semiconductor substrate 231 as by ion implantation, n-type semiconductor layers 233 intended for source and drain regions are fabricated in the p-type well 232 as by ion implantation. Reference numeral 234 denotes a gate electrode, which is fabricated on the p-type well 232 with agate insulating film therebetween. The two transistors 230 are isolated by a device-isolation region 235 fabricated as by LOCOS (Local Oxidation of Silicon). The device-isolation regions 235 serve to electrically isolate elements from each other in a case where a large number of elements are fabricated in the same substrate, and each of the n-type transistors 230 is fabricated in one of regions isolated from each other by the device-isolation regions 235. In FIG. 7A, L1 represents a length of the device-isolation region 235.

FIG. 7B illustrates a case where two transistors 230, 240 of opposite conductivity types are fabricated side by side, reference numeral 240 denotes a p-type transistor, 242 is an n-type well, 243 are p-type semiconductor layers, and 244 is a gate electrode. In this case, a potential difference between adjacent elements becomes larger compared with that in the case where the transistors of the same conductivity type are fabricated side by side, and the p-type well 232 and the n-type well 242 are adjacent to each other, and therefore a parasite transistor is easily formed, and consequently, it is necessary to select the length L2 of a device-isolation region 245 to be larger than the length L1 of the device-isolation region 235.

As explained above, in a case where a plurality of transistors are fabricated in the same substrate, if two transistors of opposite conductivity types are arranged side by side, an area of a device-isolation region increases and as a result a problem arises in that a wasted area increases.

Figure 8A:
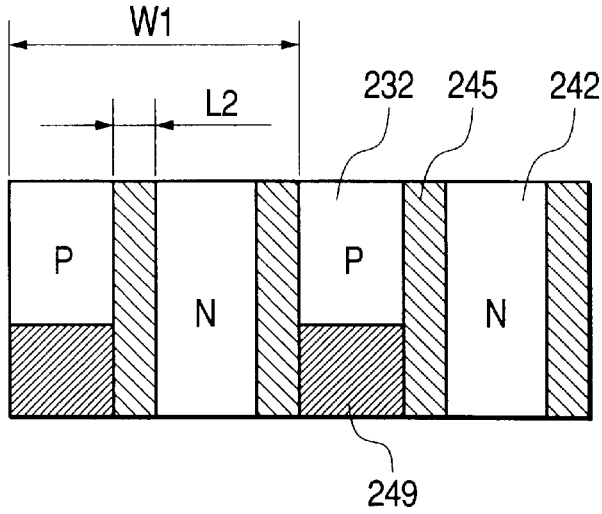
FIGS. 8A–8C are schematic plan views of three different arrangements of two transistors and areas occupied by the transistors, respectively.
Figure 8B:
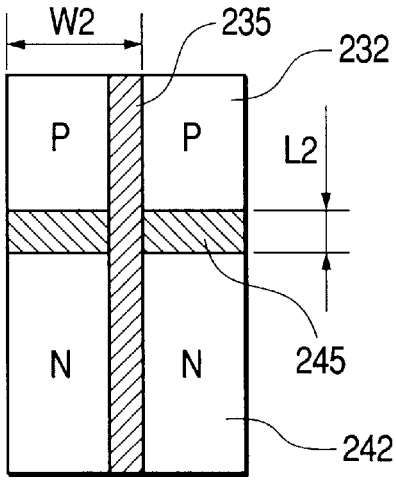
Figure 8C:
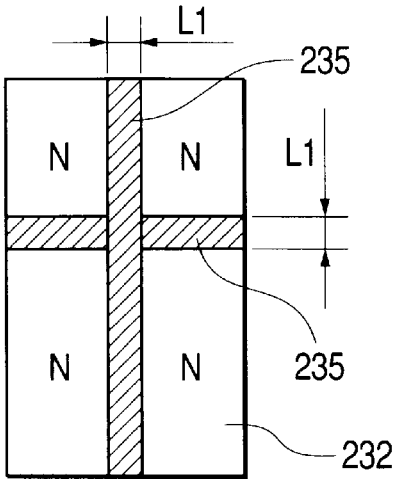

A relationship between the arrangement of transistors and an area required for their fabrication will be explained by reference to FIGS. 8A–8C. FIGS. 8A, 8B and 8C illustrate three different cases, each of which arranges two circuits composed of a pair of transistors.

FIG. 8A illustrates a case where two circuits are arranged in a horizontal direction and each of the two circuits is composed of a pair of transistors of opposite conductivity types (an n-type and a p-type) and arranged in the horizontal direction. W1 in FIG. 8A represents a with of an area required for each of the circuits. As shown in FIG. 8A, the width W1 of the respective circuits includes the width L2 of the device-isolation region 245. If an area of the p-type well 232 is not equal to that of the n-type well 242, an unused area 249 occurs.

FIG. 8B illustrates a case where two circuits of the same configuration are arranged in a horizontal direction, and each of the two circuits is composed of a pair of transistors of opposite conductivity types (an n-type and a p-type) and arranged in a vertical direction. The width of an area occupied by each of the two circuits is W2. The width W2 is smaller than the width W1, and therefore this configuration is effective for disposing the circuits within the pixel pitch as explained above. However, a device-isolation region 245 having a length L2 is disposed between the p-type and n-type wells arranged in a vertical direction, and therefore the length of the configuration of FIG. 8B is longer compared with that of a configuration in which two transistors of the same conductivity type are arranged in the vertical direction.

FIG. 8C illustrates a case where two circuits of the same configuration are arranged in a horizontal direction, and each of the two circuits is composed of a pair of transistors of the same conductivity type and arranged in a vertical direction. The length of a device-isolation region 235 is L1, which is smaller than the length L2 of FIG. 8B. Although a difference between the lengths L1 and L2 is of the order of several $\mu$m at the most, if a plurality of circuits each of which is composed of a pair of transistors are arranged successively in the vertical direction, the differences are cumulative, i.e., they add up, and therefore they cannot be ignored. When the circuits are employed in the display data processing circuit 325 of FIG. 3, for example, one display data is represented in three bits, and therefore the cumulative difference is three times the difference between the lengths L1 and L2. As the number of gray-scale levels displayed on a liquid crystal display panel is increased, and therefore as the number of bits for representing display data is increased to 8, or 16, it is effective to reduce the area of useless regions by improving the arrangement of the transistors.

In the present embodiment, as shown in FIG. 5, the data taking-in elements 171–173, the display data transfer elements 181–183, display data processing elements 201–203, and the time data processing elements 211–213 are formed of transistors of the same conductivity type, and consequently, the areas of the device-isolation regions required for the side-by-side arrangement of the transistors are further reduced. In FIG. 5, the n-type transistors are employed, but it is needless to say that this embodiment can be realized by using p-type transistors for the side-by-side arrangement of transistors of the same conductivity type, instead of the n-type transistors.

Figure 9A:
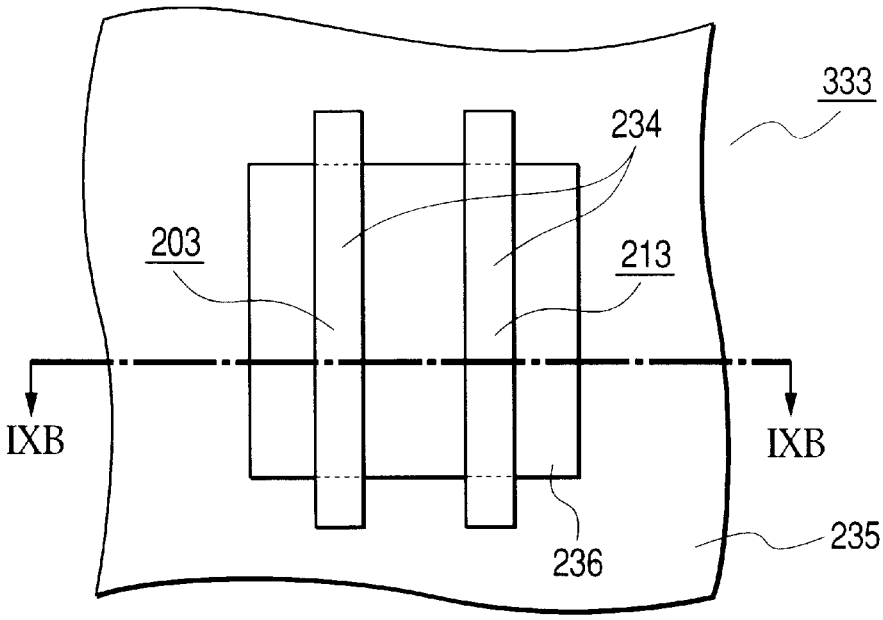
FIG. 9A is a schematic plan view illustrating a layout of two elements employed in the liquid crystal display device in accordance with an embodiment of the present invention.
Figure 9B:
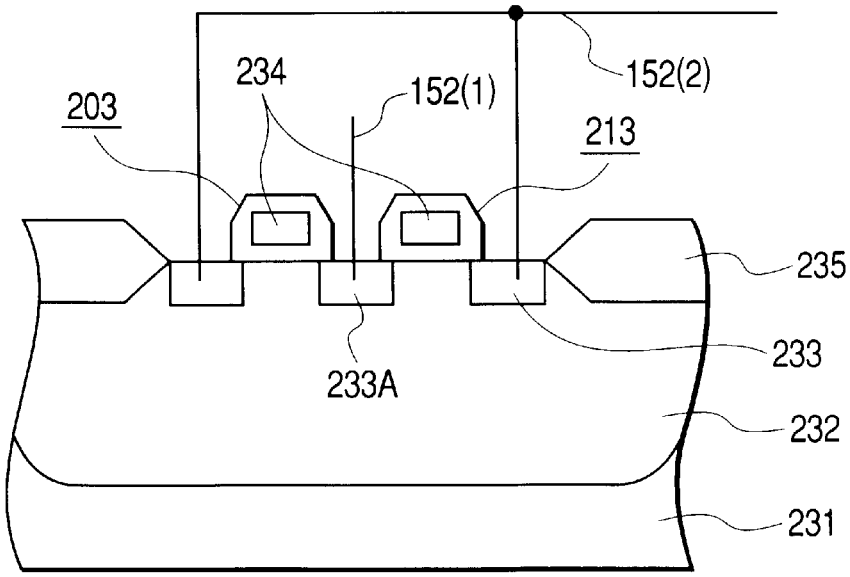
FIG. 9B is a schematic cross-sectional view taken along line IXB—IXB of FIG. 9A.

FIGS. 9A and 9B illustrates the layout of the display data processing element 203 and the time data processing element 213, FIG. 9A is a schematic plan view illustrating the layout, and FIG. 9B is a schematic cross-sectional view taken along line IXB—IXB of FIG. 9A. In FIG. 9A, the device-isolation region 235 is fabricated by the LOCOS process, and covers the semiconductor substrate 231 serving as a field oxide film. Reference numeral 236 denotes an active region disposed in the device-isolation region (the field oxide film) 235. In the active region 236 are the display data processing element 203 formed of a transistor and the time data processing element 213 formed of a transistor. Reference mineral 234 denote gate electrodes. To simplify FIGS. 9A and 9B, wiring is omitted in FIG. 9A, and electrical connections in FIG. 9B are represented by lines.

As indicated in FIG. 5, the display data processing element 203 and the time data processing element 213 are connected to the processing-result signal line 152, and since the display data processing elements 201–203 and the time data processing elements 211–213 can be fabricated in the same substrate and they can share common source or drain regions, their source or drain regions are coupled together so as to beat the same potentials. As shown in FIG. 9B, a source or drain region 233A is configured so as to be shared by the display data processing element 203 and the time data processing element 213, and therefore a multilayer wiring between the source or drain regions of the two elements 203 and 213. Because each of pairs of the display data processing elements 201–203 and the time data processing elements 211–213 shares the source or drain region 233A, it is not necessary to fabricate the device-isolation regions 235 between the display data processing elements 201–203 and the time data processing elements 211–213.

As shown in FIGS. 9A and 9B, the processing-result transmitting circuits 331–333 are composed of the two transistors, one for the display data processing element 203 and one for the time data processing element 213, the need for the device-isolation region 235 and an area for wiring can be eliminated by using the two transistors of the same conductivity type, and as a result, the area occupied by the two transistors has been made smaller than that occupied by two transistors of opposite conductivity types and arranged side by side. Consequently, the display data processing circuit 325 can be formed into a compact structure. A multilayer wiring between the display data processing elements 201–203 and the time data processing elements 211–213 are omitted, thereby reducing capacitances due to wiring and making possible high-speed operation.

As shown in FIGS. 5, 9A and 9B, in the processing-result transmitting circuits 331–333, each of the display data processing elements 201–203 is formed of one transistor, and each of the time data processing elements 211–213 is also formed of one transistor. Since the processing-result transmitting circuits 331–333 perform a digital processing by using display data and time control signals, they need an element for display data and an element for time control signals, and therefore each of the processing-result transmitting circuits 331–333 needs at least two elements. Therefore, each of the processing-result transmitting circuits 331–333 shown in FIG. 5 is formed of the smallest number of elements. As described above, the area occupied by each of the processing-result transmitting circuits 331–333 can be made smaller than that occupied by a processing-result transmitting circuit fabricated by using the smallest number, two, of conventional transistors.

Figure 10:
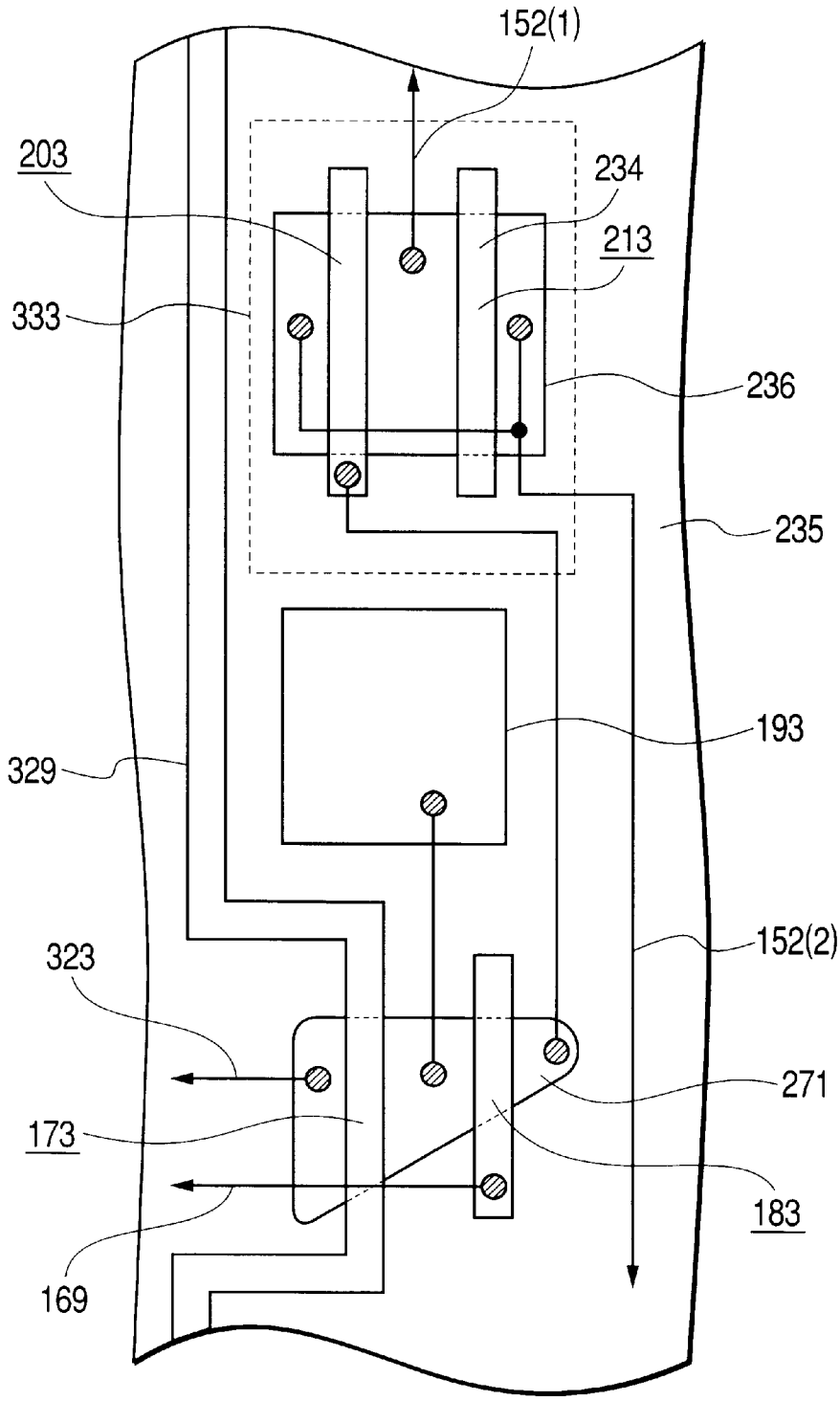
FIG. 10 is a schematic plan view illustrating a layout of a processing circuit employed in the liquid crystal display device in accordance with an embodiment of the present invention.

FIG. 10 illustrates a layout of the display data processing circuit 325. To simplify FIG. 10, wiring conductors other than the timing signal line 329 are omitted, and they are represented by lines. As explained in connection with FIGS. 9A and 9B, the display data processing element 203 and the time data processing element 213 are transistors forming the processing-result transmitting circuit 333. The data taking-in element 173 and the display data transfer element 183 shares a source or drain region equal in potential to one of two electrodes forming the memory capacitance 193. Consequently, the data taking-in element 173 and the display data transfer element 183 can be fabricated in the same substrate, and a device-isolation region between them and wiring region can be omitted.

As shown in FIG. 10, the timing signal line 329 is formed of the same conductive layer as the gate electrode of the data taking-in element 173. The timing signal line 329 is disposed adjacently to the processing-result transmitting circuit 333 and the memory capacitance 193, and a portion of the timing signal line 329 is used as a gate electrode of the data taking-in element 173.

An active region 271 for the data taking-in element 173 and the display data transfer element 183 is patterned such that its portions overlapped by the gate electrodes of the elements 173 and 183 are trapezoids. These shapes cause preferred directions in which charges appearing below the gate electrodes move easily. When the transistor is in an ON state with a voltage applied on the gate electrode, charges are generated in the active region below the gate electrode, and then when the transistor is changed into an OFF state, the charges flow into one of its source and drain regions. When a difference in length is present between the two opposing long sides of a portion of one gate electrode overlapping with the active region 271 as shown in FIG. 10, the charges flow easily toward the longer one of the two long sides.

In the case of the data taking-in element 173, when a signal of positive polarity is intended to be taken into the memory capacitance 193, the amount of negative charges flowing from the memory capacitance 193 into the display data signal line 323 is very small. Therefore, when the transistor (the data taking-in element 173) is turned OFF, if the charges below its gate electrode have flowed into the memory capacitance 193, a sufficient signal cannot be written into the memory capacitance 193. To eliminate this problem, the active region 271 is shaped as shown in FIG. 10 so that the charges can flow into the display data signal line 323 easily. The display data transfer element 183 also produces the same advantages such that the signal can be transferred easily to the succeeding circuit.

Figure 11:
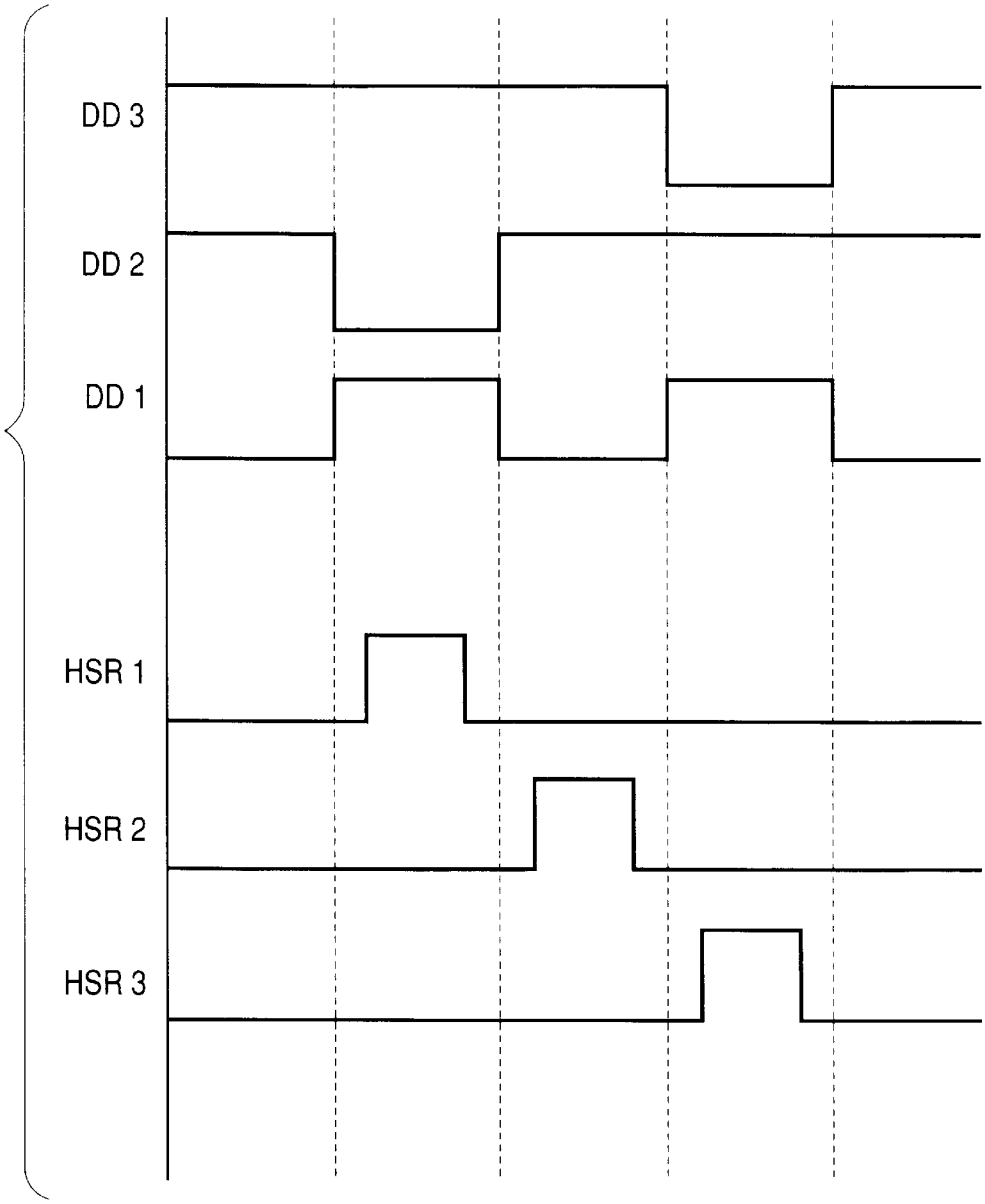
FIG. 11 illustrates waveforms of display data and timing signals for explaining the operation of the liquid crystal display device in accordance with an embodiment of the present invention.
Figure 12:
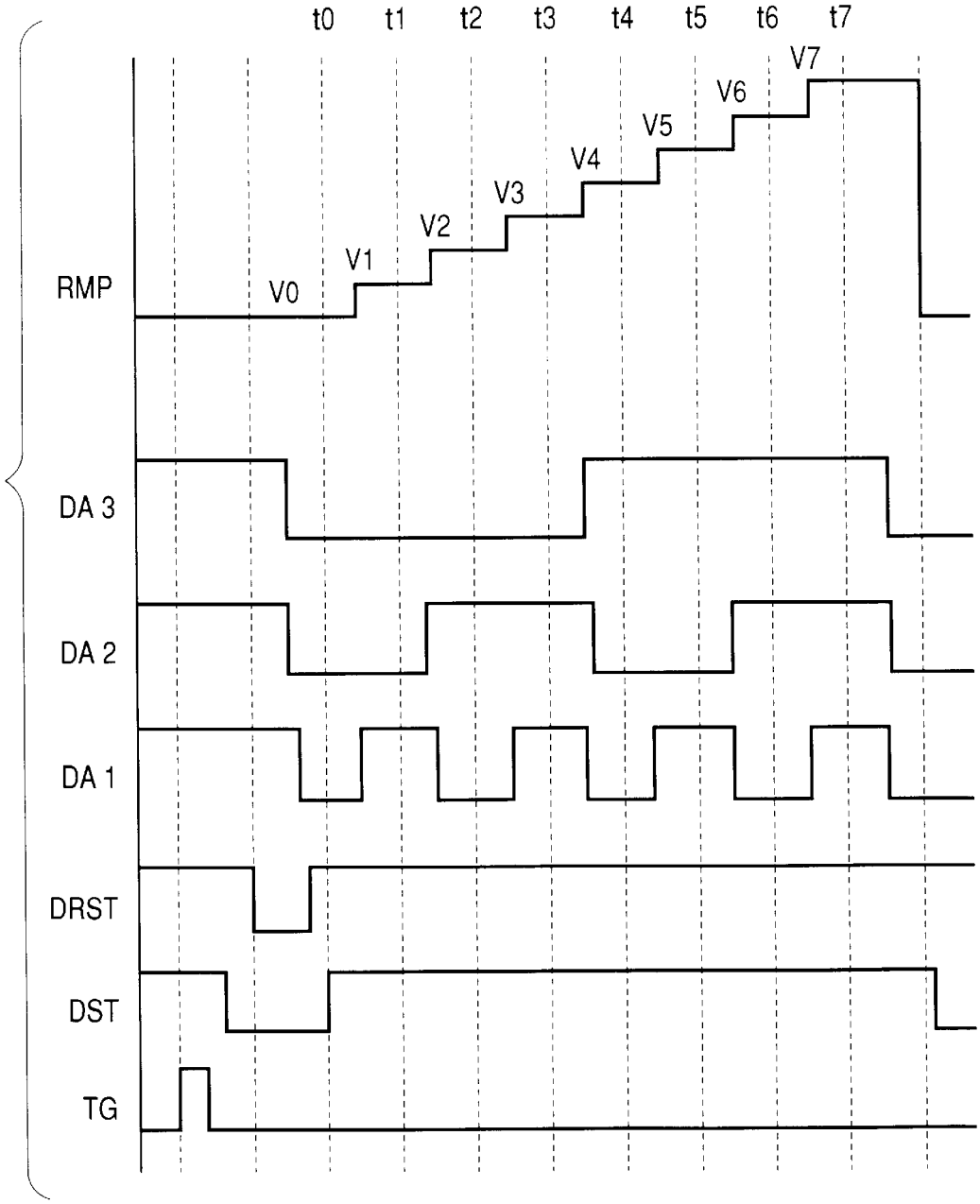
FIG. 12 illustrates waveforms of a gray-scale voltage, time control signals and timing signals for explaining the operation of the liquid crystal display device in accordance with an embodiment of the present invention.

The following explains the operation of the circuit shown in FIGS. 5 and 6 by reference to timing charts of the signals shown in FIGS. 11 and 12.

FIG. 11 illustrates the display data DD1–DD3 output to the display data lines 321–323, respectively, and the timing signals HSR1–HSR3 output from the horizontal shift register 121. In FIG. 5, the display data DD1–DD3 are output to the display data lines 321–323, respectively, and the horizontal shift register 121 outputs the timing signals HSR1–HSR3 sequentially. In FIG. 11, only three timing signals HSR1–HSR3 are shown, but it is to be understood that a necessary number of the timing signals are output from the horizontal shift register in accordance with the number of the video signal lines.

The display data DD1–DD3 represent three-bit data with DD1 being assigned to the lowest-order bit. During the time when the timing signal HSR1 is output, the display data DD1 is at a high level, the display data DD2 is at a low level, and the display data DD3 is at the high level. In the display data DD1–DD3 of this embodiment, the high and low levels are represented by "1" and "0", respectively, and therefore the above display data during the time when the timing signal HSR1 is output is represented as (1, 0, 1) in the order from the lowest-order bit.

In FIG. 11, in a state in which the display data DD1–DD3 are (1, 0, 1), when the timing signal HSR1 is output to the timing signal line 329, the data taking-in elements 171–173 are turned ON, and thereby the display data DD1–DD3 are taken into the memory capacitances 191–193, respectively. When the display data DD1–DD3 are (1, 0, 1), the memory capacitance 191 takes in a high-level voltage, the memory capacitance 192 takes in a low-level voltage, and the memory capacitance 193 takes in the high-level voltage.

Operation after the display data have been taken into the memory capacitances 191–193 will be explained by reference to FIG. 12. In FIG. 12, reference character RMP denotes a gray-scale voltage, which is supplied to the bus line 151 shown in FIG. 6 from the voltage generating circuit 112 (not shown). The gray-scale voltage RMP varies with time in the staircase fashion as shown in FIG. 12, where the assignment is made that when the display data are (1, 1, 1), a gray-scale voltage V0 is written into a pixel electrode, and when the display data are (0, 0, 0) a gray-scale voltage V7 is written into a pixel electrode.

In FIG. 12, first when the transfer signal TG changes to the high level, the display data transfer elements 181–183 are turned ON, and thereby the display data held in the memory capacitances 191–193 are transferred to the display data processing elements 201–203. Although potentials corresponding to with the display data are transferred to the gate electrodes of the display data processing elements 201–203, respectively, because the charges which were present a horizontal scanning period earlier are stored in the gate electrodes of the display data processing elements 201–203, the potentials of the gate electrodes are determined by voltage division based upon the memory capacitances 191–193 and capacitances of the respective gate electrodes and their wiring, of the potentials stored in the respective memory capacitances 191–193 and the potentials which were present in the respective gate electrodes a horizontal scanning period earlier. When the display data DD1–DD3 are (1, 0, 1) as shown in FIG. 11, the display data processing elements 201 and 203 are turned ON, and the display data processing element 202 are turned OFF.

Next in a state in which the time control pulses DA1–DA3 are at the high level, the processing-result-signal-line set signal DST is set to the low level so that a processing-result-signal-line set element 222 is turned OFF. Then the processing-result-signal-line reset signal DRST is set to the low level so that two processing-result-signal-line set elements 221 and 223 is turned OFF, and as a result the processing-result signal lines 152(1) and 152(4) are connected to the fixed-voltage lines 153 and 156, respectively, and changes to the high level.

When the processing-result signal line 152 is at the high level, the level shift circuit 141 of the gray-scale voltage output circuit 326 supplies gate voltages to the gate circuit 142 so that the gate circuit 142 electrically connects the voltage bus line 151 to the video signal line 103. This means that, during the time when the processing-result signal line 152 is at the high level, the video signal line 103 is supplied with the gray-scale voltage RMP from the voltage bus line 151. As explained above, the gray-scale voltage RMP in FIG. 12 varies with time in the staircase fashion. During the time when the processing-result signal line 152 is at the high level, the gray-scale voltage RMP shown in FIG. 12 is output to the video signal line 103.

Next the time control pulses DA1–DA3 start to be output to the time control signal lines 161–163, respectively. Then the processing-result-signal-line reset signal DRST is set to the high level, and then the processing-result-signal-line set signal DST is set to the high level. When the processing-result-signal-line set signal DST changes to the high level, the processing-result-signal-line set element 222 is turned ON, the processing-result signal line 152(1) is connected to the line 154 at the GND level, and changes to the low level.

In FIG. 12, at time t0, all of the time control pulses DA1–DA2 are at the low level, and therefore all of the time data processing elements 211–213 are ON. As a result, unless all of the display data processing elements 201–203 are ON, i.e., unless the display data 201–203 are (1, 1, 1), the potential of the processing-result signal line 152(4) is kept at the voltage VDD, and thereby the gate circuit 142 remains on the ON state.

In FIGS. 5, 6, 11 and 12, consider the display data are (1, 0, 1) in the time when the timing signal HSR1 is output, for example.

At time t0, the display data processing element 202 is turned OFF, and the processing-result signal line 152(4) is kept at VDD.

After that, at time t2 the time control pulses DA1–DA3 become (0, 1, 0), and thereby the time data processing element 212 is turned ON. On the other hand, since the display data are (1, 0, 1), the display data processing elements 201 and 203 are in the ON state. Consequently, all of the processing-result signal line 152(1) to 152(4) are connected the GND line 154, the processing-result signal line 152(4) changes to the low level, and therefore the gate circuit 142 electrically disconnects the voltage bus line 151 from the video signal line 103. Consequently, the video signal line 103 is held at a voltage V2 present on the voltage bus line 151 at the instant when the video signal line 103 is disconnected from the voltage bus line 151. Thereafter the video signal line 103 is not electrically connected to the voltage bus line 151 until the processing-result-signal-line reset signal DRST changes to the low level and thereby the processing-result signal line 152 is set to the high level.

Figure 13:
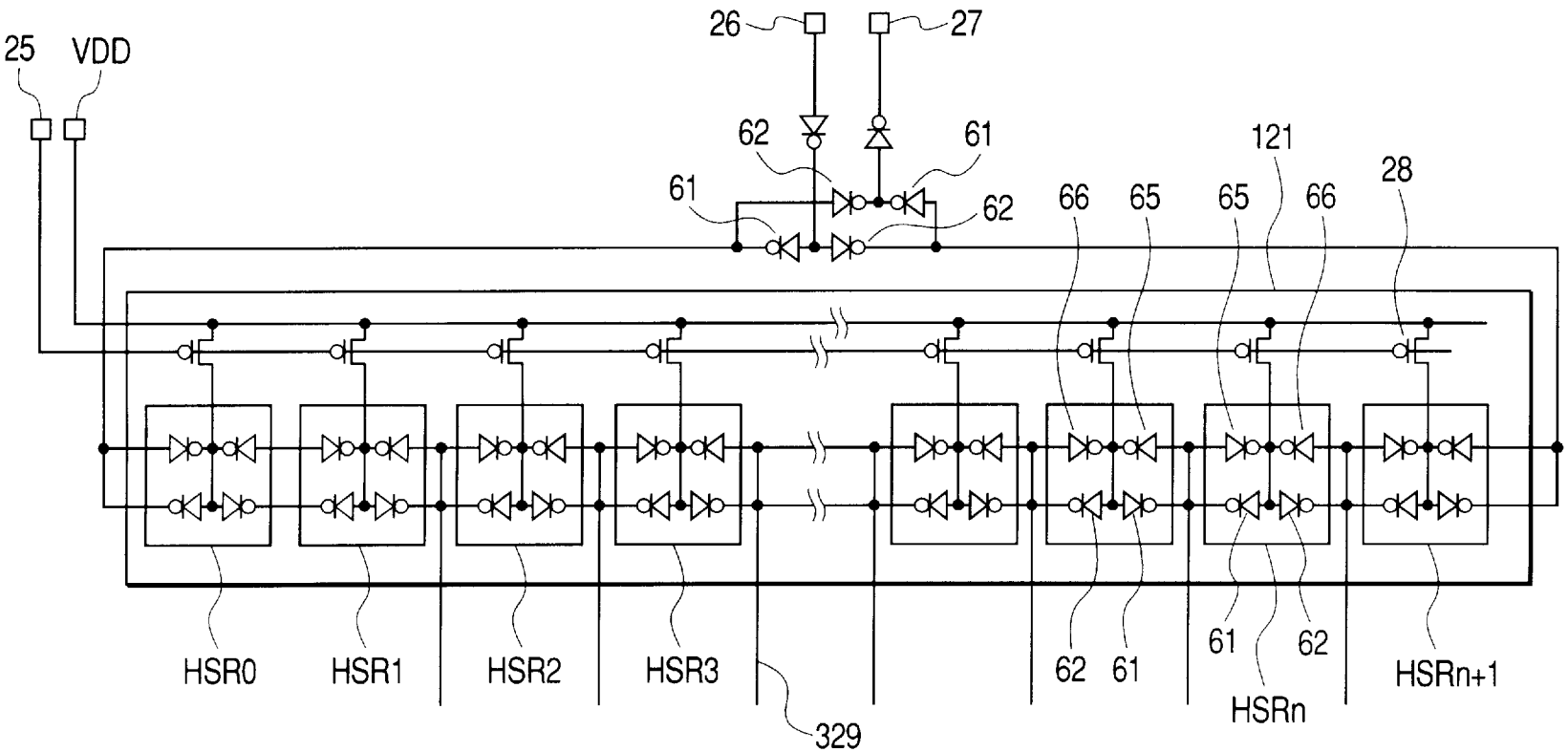
FIG. 13 is a schematic circuit diagram of a shift register employed in the liquid crystal display device in accordance with an embodiment of the present invention.

The circuit configuration of the horizontal shift register 121 will be explained by reference to FIG. 13. Reference character HSR denotes a bidirectional shift register which can shift a signal leftward and rightward. The bidirectional shift register HSR is composed of clocked inverters 61, 62, 65 and 66.

Reference numeral 25 is an input terminal for a horizontal scanning reset signal, and 26 is an input terminal for a horizontal scanning start signal. The clocked inverters 61 provide the start signal to the horizontal shift register 121 for scanning in the left-to-right direction in FIG. 13, and the clocked inverters 62 provide the start signal to the horizontal shift register 121 for scanning in the right-to-left direction in FIG. 13. Reference numeral 27 denotes an output terminal for a signal for completing the horizontal scanning.

The clocked inverters 61 and 62 employed in the bidirectional shift registers HSR will be explained by reference to FIGS. 14A and 14B. Reference characters RL1 and RL2 denote first and second horizontal direction-setting lines, respectively. The first horizontal direction-setting line RL1 provides an H level for scanning in the left-to-right direction in FIG. 13, and the second horizontal direction-setting line RL2 provides an H level for scanning in the right-to-left direction in FIG. 13. For clarity, wiring is omitted in FIG. 13, but the first and second horizontal direction-setting lines RL1 and RL2 are connected to the clocked inverters 61 and 62 constituting the bidirectional shift register HSR.

Figure 14A:
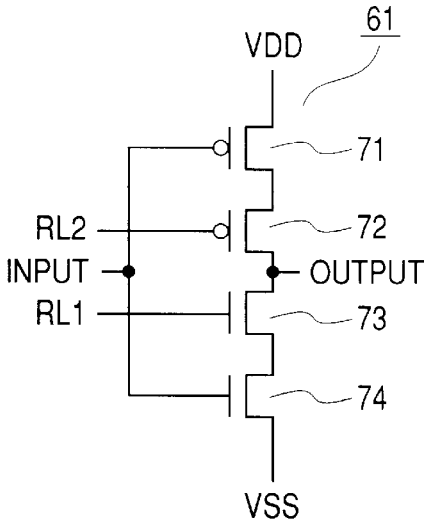
FIGS. 14A–14D are schematic circuit diagrams of four clocked inverters employed in the liquid crystal display device in accordance with an embodiment of the present invention, respectively.

The clocked inverter 61 is composed of p-type transistors 71, 72 and n-type transistors 73, 74 as shown in FIG. 14A. The p-type transistor 72 is connected to the second horizontal direction-setting line RL2, and the n-type transistor 73 is connected to the first horizontal direction-setting line RL1. When the first horizontal direction-setting line RL1 is at the H level and the second horizontal direction-setting line RL2 is at the L level, the clocked inverter 61 serves as an inverter, but when the first horizontal direction-setting line RL1 is at the L level and the second horizontal direction-setting line RL2 is at the H level, the clocked inverter 61 serves as a high impedance.

On the other hand, in the clocked inverter 62, the p-type transistor 72 is connected to the first horizontal direction-setting line RL1, and the n-type transistor 73 is connected to the second horizontal direction-setting line RL2. When the second horizontal direction-setting line RL2 is at the H level, the clocked inverter 62 serves as an inverter, and when the first horizontal direction-setting line RL1 is at the H level, the clocked inverter 62 serves a high impedance.

Figure 14B:
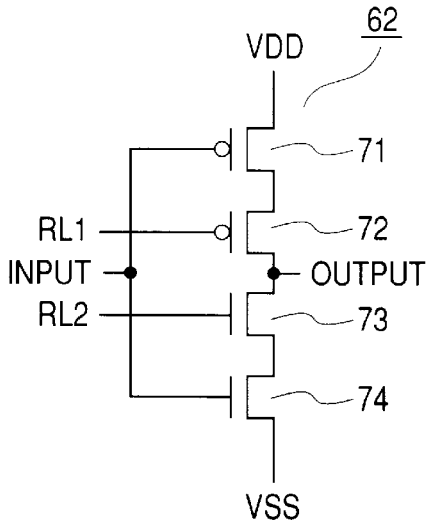
Figure 14C:
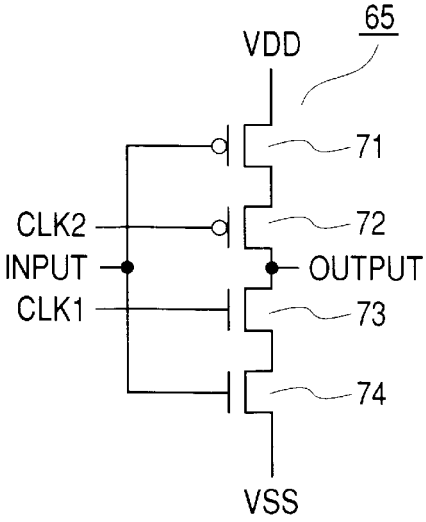

FIG. 14C illustrates a circuit configuration of the clocked inverter 65. When a clock signal line CLK1 is at the H level, and a clock line signal CLK2 is at the L level, the clocked inverter 65 outputs an inverted input, and when the clock signal line CLK1 is at the L level, and the clock signal line CLK2 is at the H level, the clocked inverter 65 serves as a high impedance.

Figure 14D:
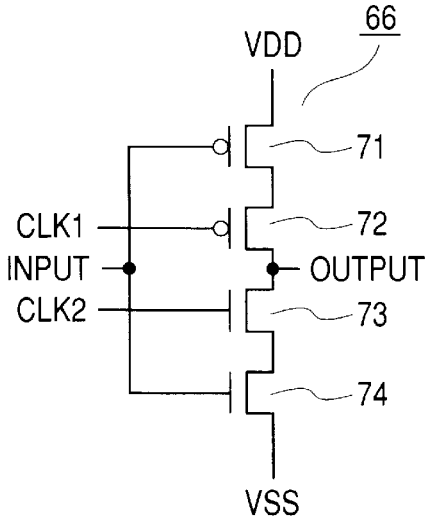

FIG. 14D illustrates a circuit configuration of the clocked inverter 66. When the clock signal line CLK1 is at the L level, and the clock signal line CLK2 is at the H level, the clocked inverter 66 outputs an inverted input, and when the clock signal line CLK1 is at the H level, and the clock signal line CLK2 is at the L level, the clocked 66 inverter serves as a high impedance. For clarity, connections of the clock signal lines CLK1, CLK2 are omitted in FIG. 13, but the clock signal lines CLK1 and CLK2 are connected to the clocked inverters 65 and 66.

Figure 15A:
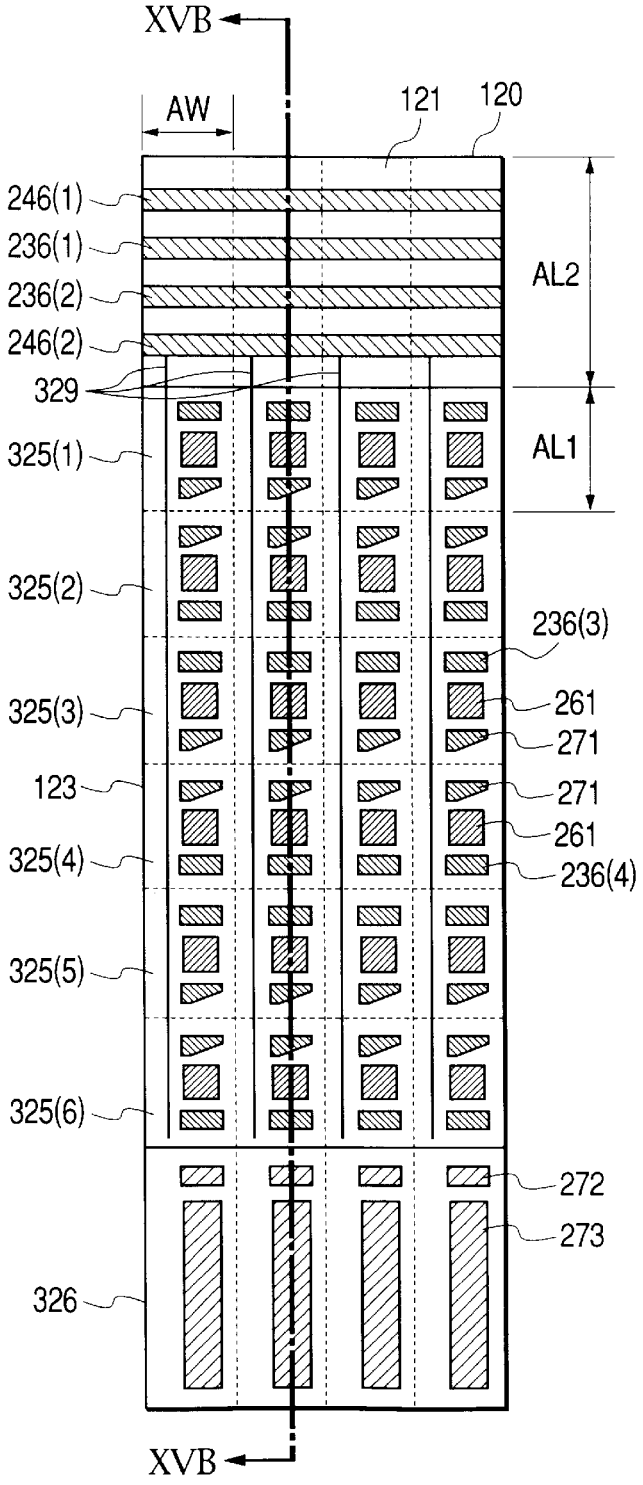
FIG. 15A is a schematic plan view illustrating a layout of transistors forming a horizontal drive circuit employed in the liquid crystal display device in accordance with an embodiment of the present invention.
Figure 15B:
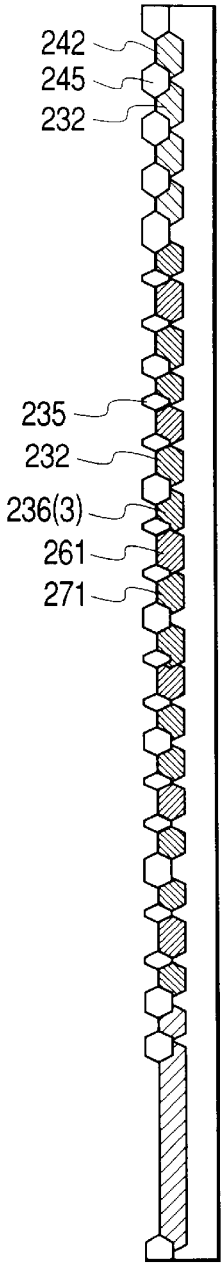
FIG. 15B is a schematic cross-sectional view of FIG. 15A taken along line XVB—XVB.

FIGS. 15A and 15B illustrate a layout of transistors constituting the horizontal drive circuit 120. FIG. 15A is a schematic plan view of the horizontal drive circuit 120, and for clarity, the horizontal drive circuits 120 corresponding to only four of the video signal lines 103 (not shown) are shown in FIGS. 15A and 15B. The width AW of each of the horizontal drive circuits 120 corresponding to a respective one of the video signal lines 103 is determined by the pixel pitch as explained above. FIG. 15B is a schematic cross-sectional view of the horizontal drive circuits 120 taken along line XVB—XVB of FIG. 15A.

Reference numeral 121 denotes the horizontal shift register, which is composed of n-type transistors and p-type transistors arranged side by side as shown in FIGS. 14A–14D. Reference numerals 246 and 236 denote active regions of the p-type and n-type transistors, respectively. In the active region 246(1), for example, the p-type transistors of the clocked inverters 61 and 62 of FIGS. 13, 14A and 14B are arranged side by side within the width AW. Likewise, in the active region 236(1) are fabricated the n-type transistors of the clocked inverters 61 and 62, in the active region 246(2) are fabricated the p-type transistors of the clocked inverters 65 and 66, and in the active region 236(2) are fabricated the n-type transistors of the clocked inverters 65 and 66. In FIG. 15B, reference numeral 242 denote n-type wells, 232 are p-type wells, and 245 are device-isolation regions provided between the n-type and p-type wells. Reference character AL2 denotes the length of the area where the horizontal shift registers 121 are formed. Reference numeral 325 denotes the display data processing circuit 325. In FIGS. 15A and 15B, six of the display data processing circuits 325(1)–325(6) are arranged in the vertical direction. Each of the display data processing circuit 325(1)–325(6) is provided so as to correspond to a respective one of the video signal lines 103, and therefore as the number of bits of the display data is increased, the area where the display data processing circuits are formed has to be lengthened in the vertical direction. To solve this problem, the display data processing circuit 325 is composed of the n-type transistors as shown in FIG. 5.

Reference numeral 236 in FIGS. 15A and 15B denote the active regions where the display data processing elements (designated 201–203 in FIG. 5) and the time data processing elements (designated 211–213 in FIG. 5) of FIG. 5. The display data processing element 203 and the time data processing element 213 are arranged laterally in the active region 236 as shown in FIGS. 9A and 9B. In FIG. 15B, reference numeral 232 denotes the n-type well, and 235 is the device-isolation region provided between the two n-type wells. Reference character AL1 denotes the length of the area where each of the display data processing circuits 325(1)–325(6) is formed. In FIGS. 15A and 15B, reference numeral 261 denote regions where the memory capacitances 191–193 of FIG. 5 are formed, and 261 are active regions where the data taking-in elements of FIG. 5 (designated 171–173 in FIG. 5) and the display data transfer elements of FIG. 5 (designated 181–183 in FIG. 5) are formed. The data taking-in elements and the display data transfer elements are laterally arranged in the active region 271 like the display data processing elements and the time data processing elements.

Reference numeral 329 in FIG. 15A denote timing signal lines (made of poly-silicon, for example) extending from the horizontal shift register 121 and connected to the respective ones of the data taking-in elements (wiring to the data taking-in elements are omitted in FIGS. 15A and 15B). Each of the timing signal lines 329 are disposed along the display data processing circuits 325(1)–325(6) so that it can supply the timing signal to all of the display data processing circuit 325(1)–325(6). Therefore the timing signal lines 329 are lengthened in the vertical direction as the number of bits of the display data is increased, and hence the number of the display data processing circuits 325(1), 325(2), . . . is increased.

As the timing signal line 329 is lengthened, wiring resistance increases. Since the timing signal is a pulse of high frequency, the increase in the wiring resistance causes distortions in the waveform of the timing signal. The waveform distortions in the timing signal produces errors in timing of taking-in of the display data into the data taking-in elements 171–173. For example, a problem arises in that, while the display data processing circuit 325(1) has taken in a display data at a given instant of time, the display data processing circuit 325(6) has not taken in a display data, and display quality is degraded.

When the wiring resistance and capacitance of the timing signal line 329 are considered, it is desirable to make the length AL1 of the display data processing circuit 325 as short as possible. When the length AL2 of the horizontal shift register 121 is longer than the length AL1 of each of the display data processing circuits 325(1), 325(2), 325(3), . . . The overall length of the display data processing circuits 325(1), 325(2), 325(3), . . . is the product of the length AL1 and the number of the display data bit, and therefore, if the number of display data bits is increased, it is effective for reducing the lengths of the entire circuits and the timing signal lines 329 to shorten the length AL1 of each of the display data processing circuits 325(1), 325(2), 325(3), . . . . In view of the above, the length AL1 of the display data processing circuits 325(1), 325(2), 325(3), . . . is reduced by forming the circuits 325(1), 325(2), 325(3), . . . using n-type transistors, and thereby reducing the length of the device-isolation regions 235.

In FIG. 15A, reference numeral 326 denotes the gray-scale voltage output circuit, 272 and 273 are active regions of p-type and n-type transistors of the level shift circuit 141, respectively. The active region 273 are made larger than the other active regions for increasing the ON and OFF speeds of the transistors.

As explained above, in the design of the layout of transistors constituting the horizontal drive circuit 120, the length of the drive circuit can be reduced by forming the drive circuit by using transistors of the same conductivity type and locating the circuit within the pixel pitch. Even if the area of the display section of a liquid crystal display panel is reduced, but the numbers of gray-scale levels and pixels are increased, the drive circuit can be realized which has an area smaller than the display section. The wiring resistance of the timing signal lines used for taking in display data can be kept to a low value by shortening the length of the drive circuit even when the number of gray scale levels, and thereby errors in taking-in the display data can be reduced.

Figure 16:
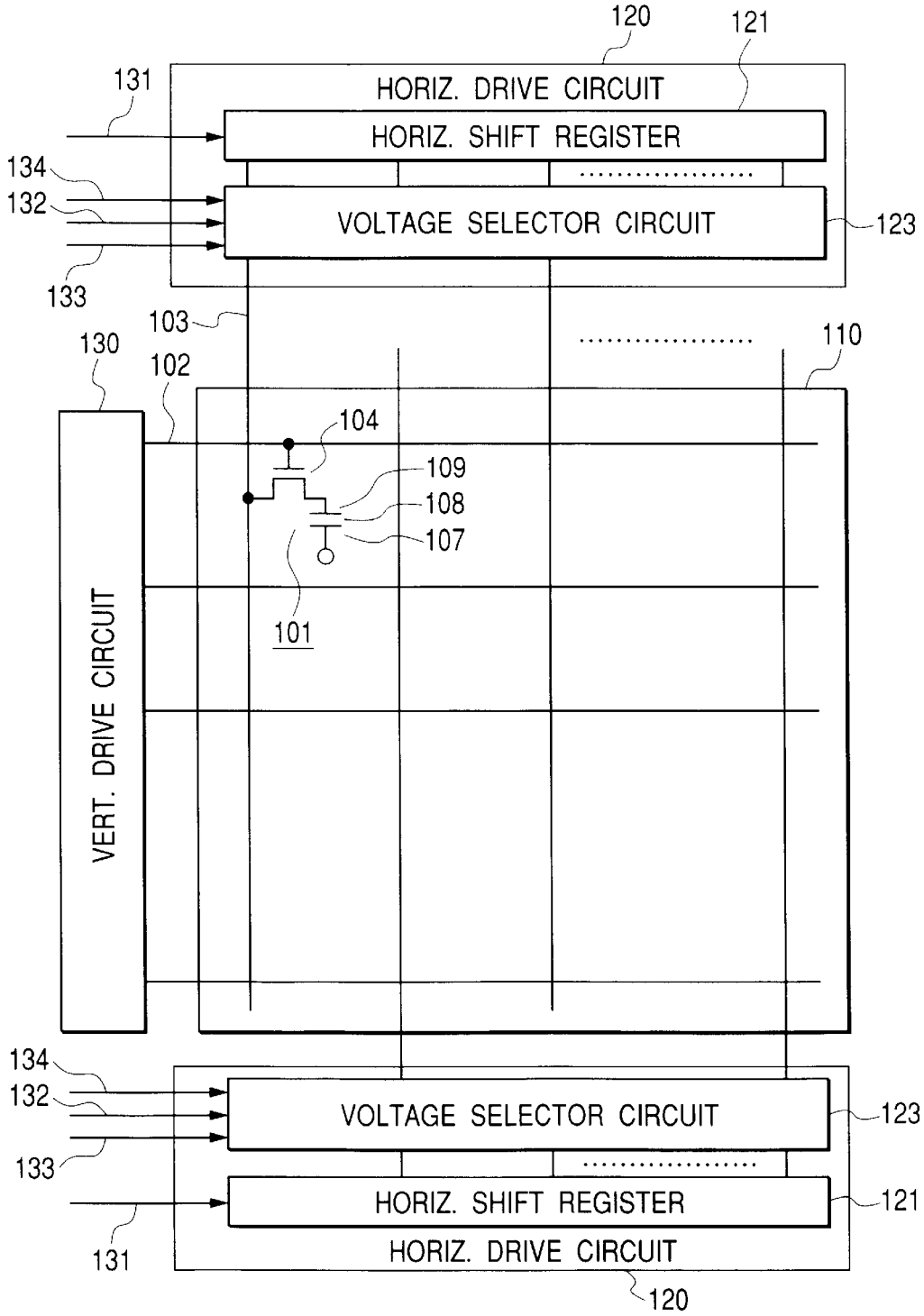
FIG. 16 is a block diagram for explaining a rough configuration of a two-system horizontal drive circuit employed in the liquid crystal display device in accordance with an embodiment of the present invention.
Figure 17:
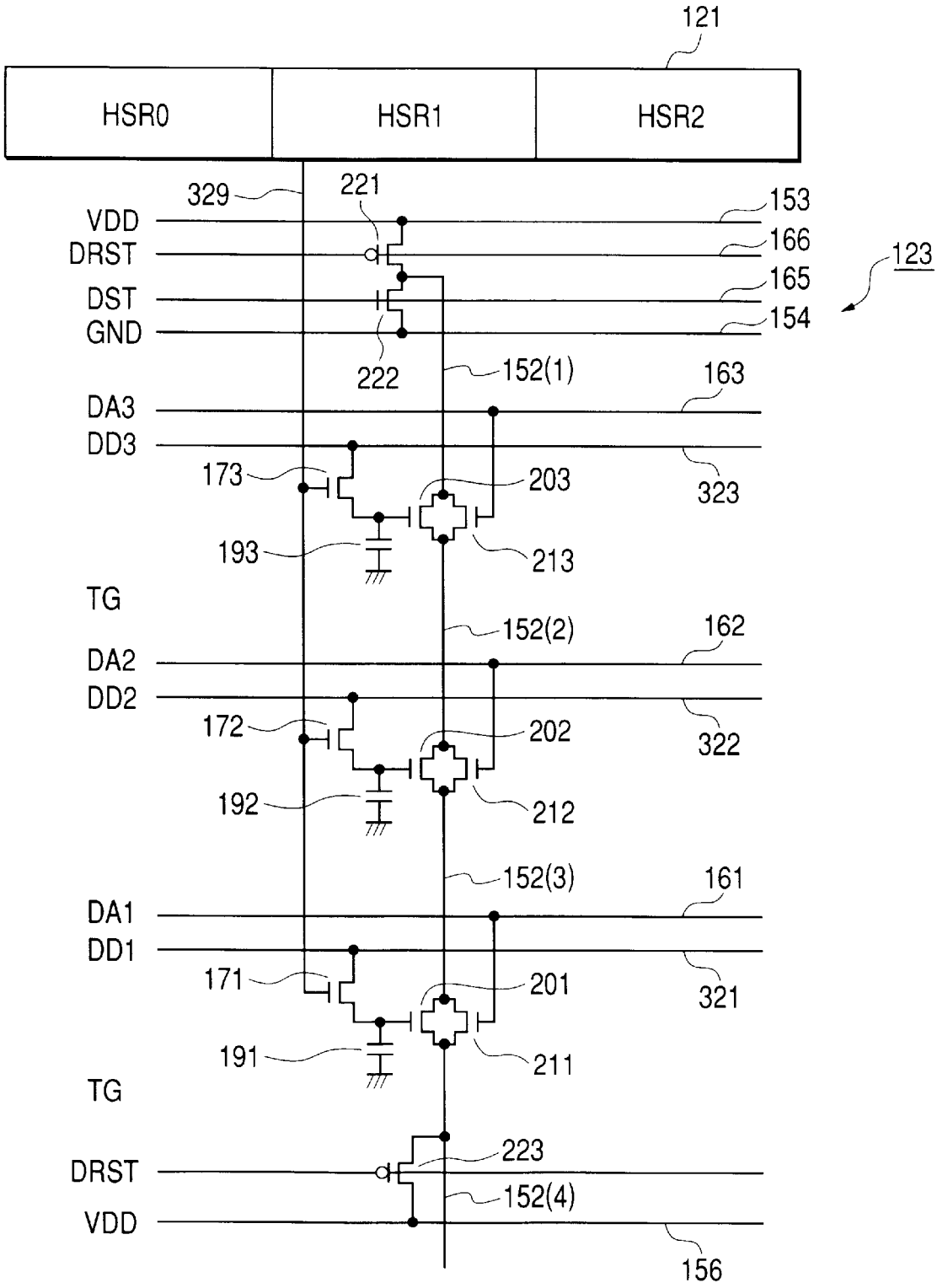
FIG. 17 is a schematic circuit configuration of a horizontal drive circuit employed in the liquid crystal display device in accordance with an embodiment of the present invention.

FIG. 16 illustrates a configuration employing two systems of the horizontal drive circuits 120. In FIG. 16, the two systems of the horizontal drive circuits 120 are illustrated as disposed at the top and bottom sides of the display section 110, but both of the two systems can be disposed at one of the top and bottom sides of the display section 110. FIG. 17 illustrates a circuit configuration of the voltage selector circuit 123 suitable for a case in which two systems of the horizontal drive circuits 120 are employed. In the horizontal drive circuits 120 shown in FIG. 16, during the time when the voltage selector circuit 123 in one of the two systems takes in display data, the voltage selector circuit 123 in the other of the two systems can select a gray-scale voltage, and as a result the display data transfer elements can be omitted as shown in FIG. 17.

Figure 18:
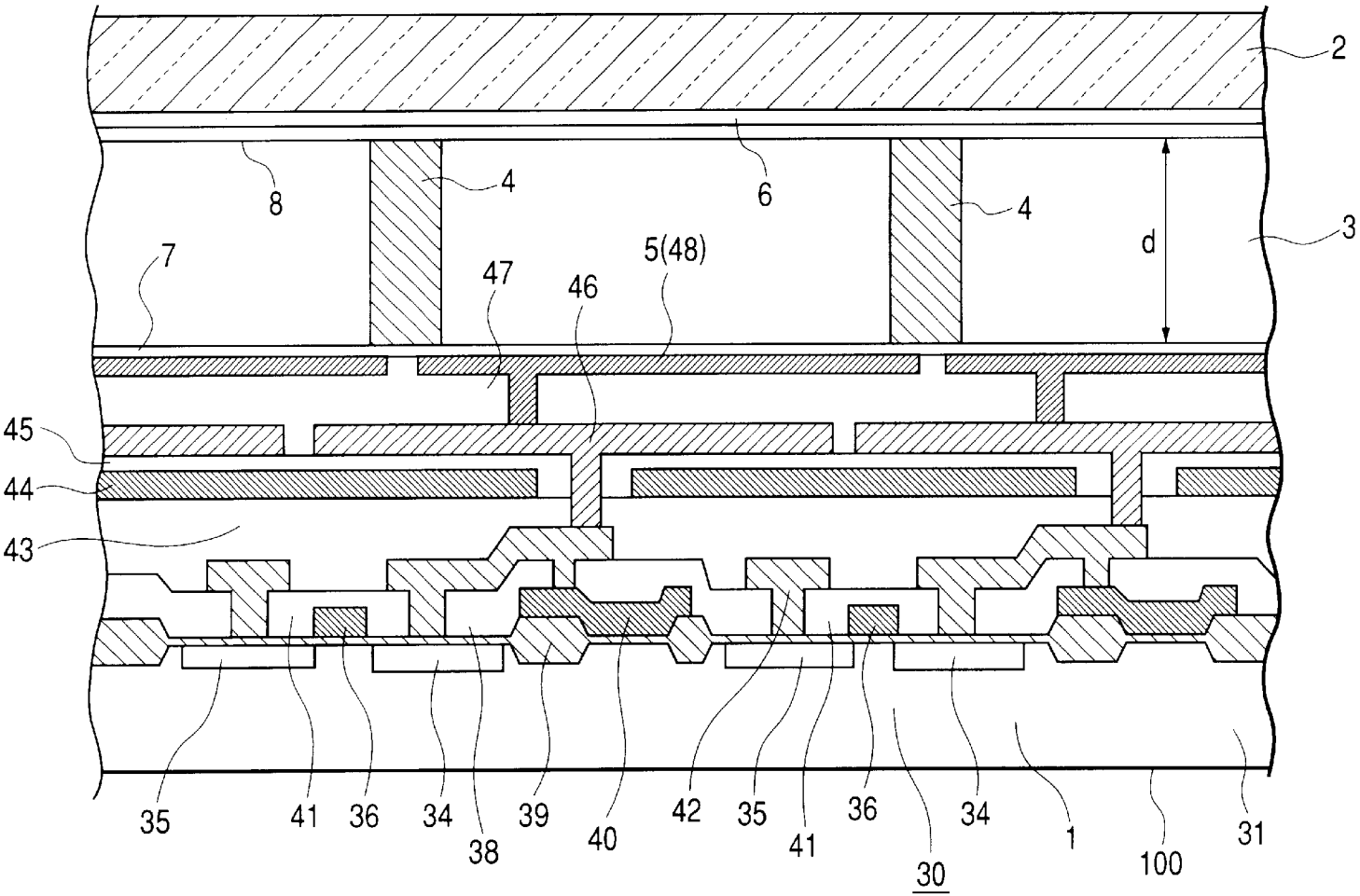
FIG. 18 is a schematic cross-sectional view of a pixel section in the liquid crystal display device in accordance with an embodiment of the present invention.

The following explains the pixel section in the liquid crystal display device in accordance with the present invention by reference to FIG. 18. FIG. 18 is a schematic cross-sectional view of an embodiment in accordance with the present invention.

In FIG. 18, reference numeral 100 denotes a liquid crystal display panel, 1 is a first substrate serving as a drive circuit substrate, 2 is a second substrate serving as a transparent substrate, 3 is a liquid crystal composition, 4 are spacers. The spacers 4 establish a fixed cell gap d between the drive circuit substrate 1 and the transparent substrate 2 which sandwich the liquid crystal composition 3. Reference numeral 5 denotes a reflective electrode formed on the drive circuit substrate 1, 6 is a counter electrode for applying a voltage across the liquid crystal composition 3 in cooperation with the reflective electrode 5, 7 and 8 are orientation films for orientating liquid crystal molecules of the liquid crystal composition 3 in specified directions, and 30 are active elements for applying a voltage to the reflective electrode 5.

Reference numeral 34 denote drain regions, 35 are source regions, 36 are gate electrodes, 38 are insulating films, 39 are field oxide films for electrically isolating transistors from each other, 40 is a storage-capacitance-forming electrode for forming a capacitance in cooperation with the drive circuit substrate 1 with an insulating film 38 interposed therebetween, 41 are first interlayer insulating films, 42 are first conductive films, 43 are second interlayer insulating films, 44 are first light blocking films, 45 are third interlayer insulating films, 46 are second light blocking films, 47 are fourth interlayer insulating films, and 48 are second conductive films forming the reflective electrodes 5.

The liquid crystal display panel in this embodiment is of the reflective type. Light projected into the liquid crystal display panel 100 enters from the transparent substrate 2 (at the top of FIG. 18), then passes through the liquid crystal composition 3, then is reflected back by the reflective electrode 5, then passes through the liquid crystal composition 3 and the transparent substrate 2 again, and then leaves the liquid crystal display panel 100.

In the liquid crystal display panel of the reflective type, when the reflective electrode 5 is disposed on the surface of the drive circuit substrate 1 on its liquid crystal composition 3 side, an opaque substrate such as a silicon substrate can be used as the drive circuit substrate 1. This structure has advantages that the active elements 30 and wiring can be disposed below the reflective electrodes 5, thereby the area of the reflective electrodes 5 can be increased which form pixels, and consequently the higher aperture ratio can be realized. Also this structure has an advantage of radiating heat generated by light projected into the liquid crystal display panel 100 from the back surface of the drive circuit substrate 1.

Next, operation of the liquid crystal display panel employing the electrically controlled birefringence mode will be explained. Light linearly polarized by a polarizer enters the liquid crystal display panel 100. When a voltage is applied between the reflective electrode 5 and the counter electrode 6, orientation of liquid crystal molecules of the liquid crystal composition 3 is changed due to their dielectric anisotropy, and as a result the birefringence of the layer of the liquid crystal composition 3 is changed. The electrically controlled birefringence mode generates images by converting the changes of the birefringence into the changes of light transmission.

Next, the single-polarizer twisted nematic (SPTN) mode, which is one type of the electrically controlled birefringence mode, will be explained by reference to FIGS. 19A and 19B.

Reference numeral 9 denotes a polarizing beam splitter which divides an incident light L1 from a light source (not shown) into two polarized lights, and a linearly polarized light L2 of the two is emitted.

Figure 19B:
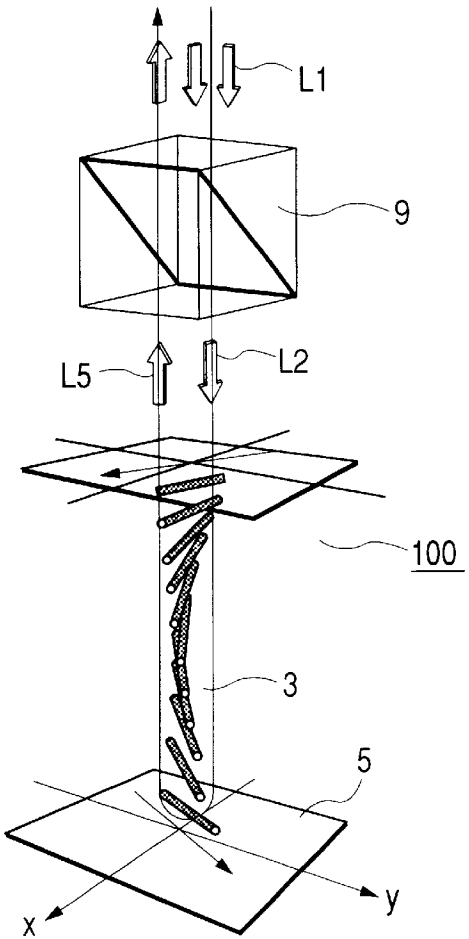
FIGS. 19A and 19B illustrate field-off and field-off states of a single-polarizer twisted nematic (SPTN) mode applied to the liquid crystal display device in accordance with an embodiment of the present invention, respectively.
Figure 19A:
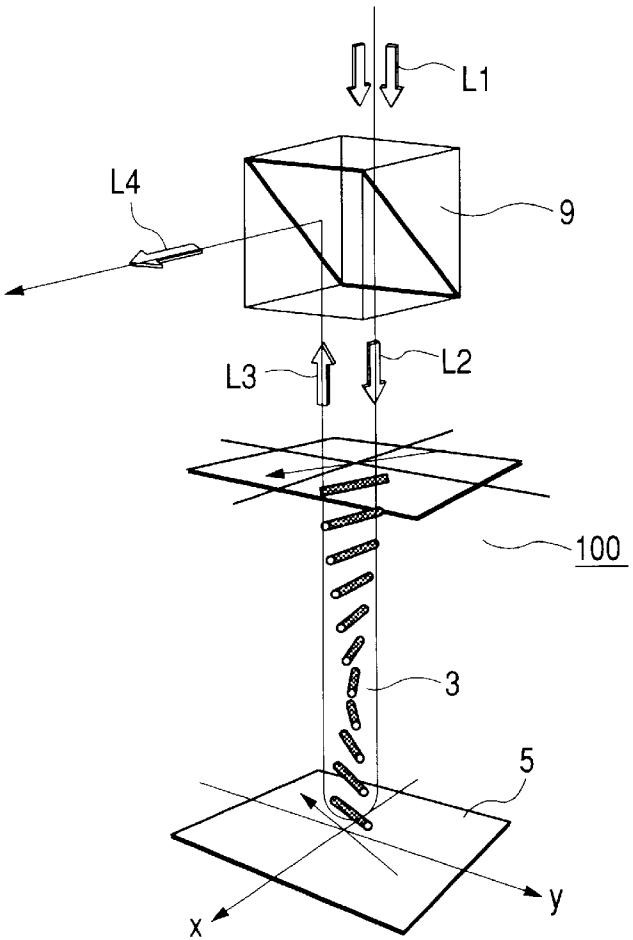

In FIGS. 19A and 19B, a light having passed through the polarizing beam splitter 9, which is a p-polarized light, is entered into the liquid crystal display panel 100, but instead a light reflected by the polarizing beam splitter 9, which is an s-polarized light, can be entered into the liquid crystal display panel 100.

The liquid crystal composition 3 is a nematic liquid crystal material having positive dielectric anisotropy. Longitudinal axes of the liquid crystal molecules are oriented approximately in parallel with the major surfaces of the drive circuit substrate 1 and the transparent substrate 2, and the liquid crystal molecules are twisted through about 90 degrees across the liquid crystal layer by the orientation films 7, 8.

FIG. 19A illustrates a case where no voltage is applied across the layer of the liquid crystal composition 3. The light L2 entering the liquid crystal display panel 100 is converted into elliptically polarized light by birefringence of the liquid crystal composition 3, and then becomes circularly polarized light on the reflective electrode 5. The light reflected by the reflective electrode 5 passes through the liquid crystal composition 3 again, thereby becomes elliptically polarized light again, and then returns to linearly polarized light again when it leaves the liquid crystal display panel 100. The emergent linearly polarized light L3 is s-polarized light having its direction of polarization rotated through an angle of 90° with respect to that of the incident light L2, enters the polarizing beam splitter 9 again, and then is reflected by an internal interface of the polarizing beam splitter 9 to become emergent light L4 which in turn is projected onto a screen or the like to produce a display. This configuration is of the so-called normally white (normally open) type which emits light when a voltage is not applied across the layer of the liquid crystal composition 3.

FIG. 19B illustrates a case where a voltage is applied across the layer of the liquid crystal composition 3. When an electric field is applied across the layer of the liquid crystal composition 3, the liquid crystal molecules align in a direction of the electric field and consequently, the birefringence of the liquid crystal molecules does not appear. As a result, the linearly polarized light L2 entering the liquid crystal display panel 100 is reflected by the reflective electrode 5 without undergoing changes, and then the light L5 emergent from the liquid crystal display panel 100 has the same direction of polarization as that of the incident light L2. The emergent light L5 passes through the polarizing beam splitter 9, and returns to the light source such that no light is projected onto the screen and a black display is provided on the screen.

In the single-polarizer twisted nematic mode, the direction of orientation of the liquid crystal molecules is parallel with the major surfaces of the substrates, and therefore usual methods of orientating the liquid crystal molecules can be employed and its manufacturing process is highly stable. The normally white mode operation is preventive of defective displays occurring at low voltage levels. The reason is that, in the normally white mode, a dark level (a black display) is provided when a high voltage is applied across the liquid crystal layer, and in this state, almost all the liquid crystal molecules are orientated in the direction of the electric field which is perpendicular to the major surfaces of the substrates, and consequently, a display of the dark level does not depend very much upon the initial conditions of orientation of the liquid crystal molecules having a low electric field applied thereto.

The human eye perceives non-uniformity in luminance based upon the ratio of luminances, is responsive approximately to the logarithm of luminance, and consequently, is sensitive to variations in dark levels.

Because of the above reasons, the normally white mode has advantages with respect to prevention of non-uniformity in luminance caused by initial conditions of orientation of the liquid crystal molecules.

The electrically controlled birefringence mode requires a highly precise cell gap between the substrates of the liquid crystal display panel. The electrically controlled birefringence mode utilizes a phase difference between ordinary rays and extraordinary rays caused while they pass through the liquid crystal layer, and therefore the intensity of the light transmission through the liquid crystal layer depends upon the retardation $\Delta n \cdot d$ between the ordinary and extraordinary rays, where $\Delta n$ is a birefringence and d is a cell gap established by spacers 4 between the transparent substrate 2 and the drive circuit substrate 1.

In this embodiment, in view of non-uniformity in display, the cell gap was controlled with accuracy of $\pm 0.05\ \mu m$. In the reflective type liquid crystal display panel, light entering the liquid crystal layer is reflected by the reflective electrode, and then passes through the liquid crystal layer again, therefore, if the reflective type liquid crystal display panel uses a liquid crystal composition having the same birefringence $\Delta n$ as that of a liquid crystal composition used in the transmissive type liquid crystal display panel, the cell gap d of the reflective type liquid crystal display panel is half that of the transmissive type liquid crystal display panel. Generally, the cell gap d of the transmissive type liquid crystal display panel is in a range of from about 5 microns to about 6 microns, but in this embodiment the cell gap d is selected to be about 2 microns.

In this embodiment, to ensure a high accuracy of the cell gap and a smaller cell gap than that of conventional liquid crystal display panels, column-like spacers are fabricated on the drive circuit substrate 1 instead of using a bead-dispersing method.

Figure 20:
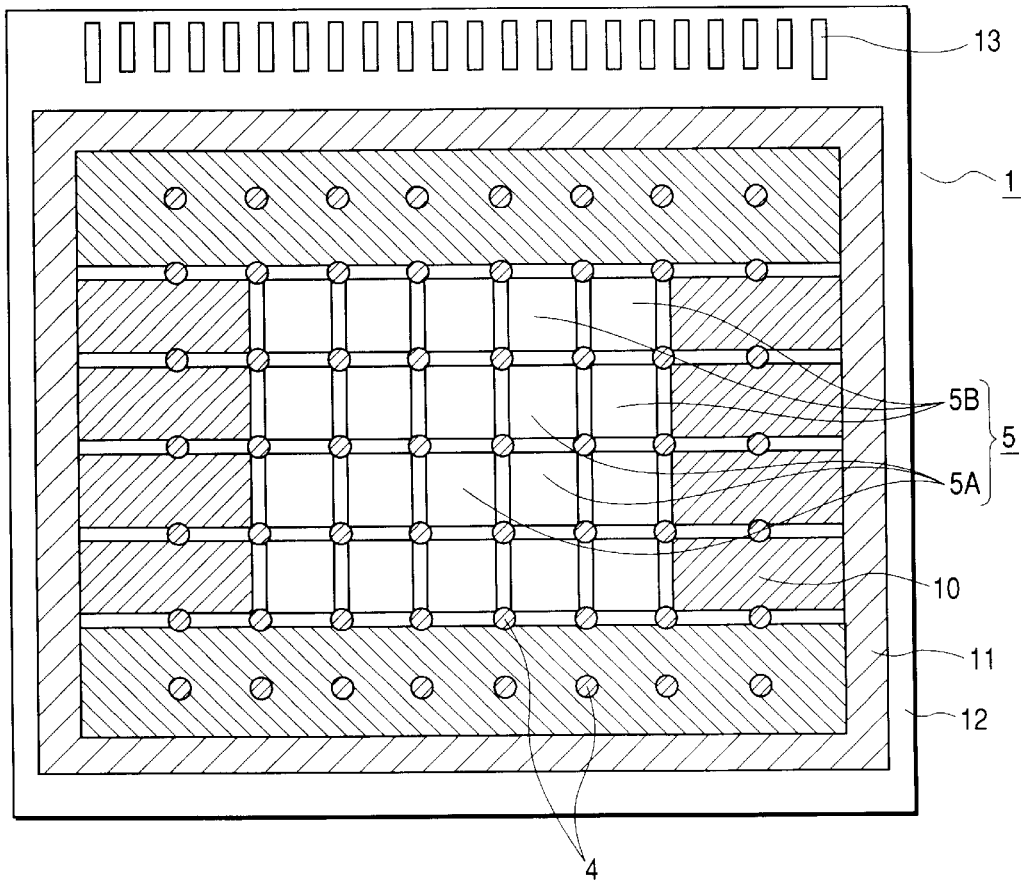
FIG. 20 is a schematic plan view illustrating an arrangement of reflective electrodes and spacers disposed on a drive circuit substrate of the liquid crystal display device in accordance with an embodiment of the present invention.

FIG. 20 is a schematic plan view of a liquid crystal display panel for explaining an arrangement of the reflective electrodes 5 and the spacers 4 disposed on the drive circuit substrate 1. A large number of spacers 4 are arranged in a matrix array over the entire area of the drive circuit substrate 1 for establishing a uniform spacing between the transparent substrate 2 and the drive circuit substrate 1. Each of the reflective electrodes 5 defines a pixel serving as the smallest picture element formed by the liquid crystal display panel. For the sake of simplicity, FIG. 20 illustrates an array of five columns by four rows of pixels, pixels in the outermost columns and rows are represented by reference numeral 5B, pixels within the outermost columns and rows are represented by reference numeral 5A.

In FIG. 20, the array of five columns by four rows of pixels forms a display area, in which a display by the liquid crystal display panel is formed. Dummy pixels 10 are disposed around the display area, a peripheral frame 11 made of the same material as that of the spacers 4 is disposed around the dummy pixels 10, and a sealing member 12 is coated around the peripheral frame 11 on the drive circuit substrate 1. Reference numeral 13 denotes terminals for external connections which are used for supplying external signals to the liquid crystal display panel 100.

The spacers 4 and the peripheral frame 11 are formed of resin material. As the resin material can be used a chemically amplified type negative photoresist "BPR-113" (a trade name) manufactured by JSR Corp. (Tokyo, Japan), for example. The photoresist material is coated as by a spin coating method on the drive circuit substrate 1 having the reflective electrodes 5 formed thereon, then is exposed through a mask having a pattern in the form of the spacers 4 and the peripheral frame 11, and then is developed by a remover to form the spacers 4 and the peripheral frame 11.

When the spacers 4 and the peripheral frame 11 is fabricated by using photoresist or the like as their material, the height of the spacers 4 and the peripheral frame 11 can be controlled by coating thickness of the material, and therefore the spacers 4 and the peripheral frame 11 can be fabricated with high precision. The positions of the spacers 4 can be determined by the mask pattern, and consequently, the spacers 4 can be located at the desired positions accurately.

In the liquid crystal display panel employed in a liquid crystal projector, if one of the spacers 4 is present on a pixel, a problem arises in that a shadow of the spacer 4 is visible in its projected enlarged image. By fabricating the spacers 4 by exposure through a mask pattern and subsequent development, the spacers 4 can be located at such positions as not to deteriorate the quality of a displayed image.

Since the spacers 4 and the peripheral frame 11 have been fabricated simultaneously, the liquid crystal composition 3 can be sealed between the drive circuit substrate 1 and the transparent substrate 2, by initially dropping a small amount of the liquid crystal composition 3 on the drive circuit substrate 1, then overlapping the transparent substrate 2 on the drive circuit substrate 1 with the liquid crystal layer therebetween, and then bonding the transparent substrate 2 to the drive circuit substrate 1.

When the liquid crystal display panel 100 has been assembled after interposing the liquid crystal composition 3 between the driving circuit substrate 1 and the transparent substrate 2, the liquid crystal composition 3 is held within a region surrounded by the peripheral frame 11.

The sealing member 12 is coated around the outside of the peripheral frame 11 and confines the liquid crystal material 3 within the liquid crystal display panel 100.

As described above, the peripheral frame 11 is fabricated by using the pattern mask, and therefore it is fabricated on the driving circuit substrate 1 with high positional accuracy, and consequently, the border of the liquid crystal composition 3 can be defined with high accuracy. Further, the peripheral frame 11 can define the border of the sealing member 12 with high accuracy.

The sealing member 12 serves to fix the driving circuit substrate 1 and the transparent substrate 2 together, and also serves to prevent materials harmful to the liquid crystal composition 3 from penetrating thereinto. When the fluid sealing member 12 is applied, the peripheral frame 11 serves as a stopper against the sealing member 12. By disposing the peripheral frame 11 as the stopper against the sealing member 12, the borders of the liquid crystal composition 3 and the sealing member 12 can be established with high precision, and consequently, the region between the display area and the peripheral sides of the liquid crystal display panel 100 can be reduced, resulting in the reduction of the peripheral border around the display area.

Dummy pixels 10 are disposed between the peripheral frame 11 and the display area for making the quality of the display produced by the outermost pixels 5B equal to that of the display produced by the inner pixels 5A disposed inside the outermost pixels 5B. Since the inner pixels 5A have neighboring pixels, unwanted electric fields are generated between the inner pixels 5A and their neighboring pixels, and consequently, the quality of the display produced by the inner pixels 5A is made worse compared with that produced in the absence of their neighboring pixels.

On the other hand, assume a case where none of the dummy pixels 10 are provided, then unwanted electric fields degrading the display quality are not produced around the outermost pixels 5B, and as a result the display quality by the outermost pixels 5B is better compared with that by the inner pixels 5A. If some pixels have difference in display quality between them, non-uniformity occurs in display. To eliminate this problem, the dummy pixels 10 are provided and are supplied with signal voltages like the pixels 5A and 5B so that the display quality of the outermost pixels 5B is equalized with that of the inner pixels 5A.

Further, since the peripheral frame 11 is fabricated to surround the display area, a problem arises in that, in performing a rubbing treatment on the surface of the drive circuit substrate 1 for orientating the liquid crystal molecules of the liquid crystal composition 3 in a specified direction, the peripheral frame 11 impedes the rubbing treatment of the surface in the vicinity of the peripheral frame 11. In this embodiment, a liquid crystal molecule orientation film 7 (see FIG. 18) is coated on the drive circuit substrate 1 after the spacers 4 and the peripheral frame 11 are fabricated on the drive circuit substrate 1, and then the rubbing treatment is performed by rubbing the liquid crystal molecule orientation film 7 with a cloth or the like such that the rubbed orientation film 7 orients the liquid crystal molecules of the liquid crystal composition 3 in a specified direction.

In the rubbing treatment, because the peripheral frame 11 is raised above the surface of the drive circuit substrate 1, the orientation film 7 in the vicinity of the peripheral frame 11 is not rubbed sufficiently because of the step formed by the peripheral frame 11, and consequently, non-uniformity in orientation of the liquid crystal molecules is apt to occur in the vicinity of the peripheral frame 11. In order to make inconspicuous non-uniformity in a display caused by defective orientation of the liquid crystal molecules of the liquid crystal composition 3, some of the pixels immediately inside the peripheral frame 11 are fabricated as dummy pixels 10 which do not contribute to a display.

However, if the dummy pixels 10 are supplied with signals like the pixels 5A and 5B, a problem arises in that displays produced by the dummy pixels 10 are also observed by the viewer because of presence of the liquid crystal composition 3 between the dummy pixels 10 and the transparent substrate 2. In the liquid crystal display panel of the normally white type, the dummy pixels 10 appear white when a voltage is not applied across the layer of the liquid crystal composition 3, and consequently, the border of the display area becomes ill-defined and the quality of a display is deteriorated. It is conceivable to mask the dummy pixels 10, but it is difficult to fabricate a light-blocking frame at the border of the display area accurately because of a spacing of a few microns between the pixels, and therefore the dummy pixels 10 are supplied with such a voltage that the dummy pixels 10 display black images which appear as a black peripheral frame surrounding the display area.

Figure 21:
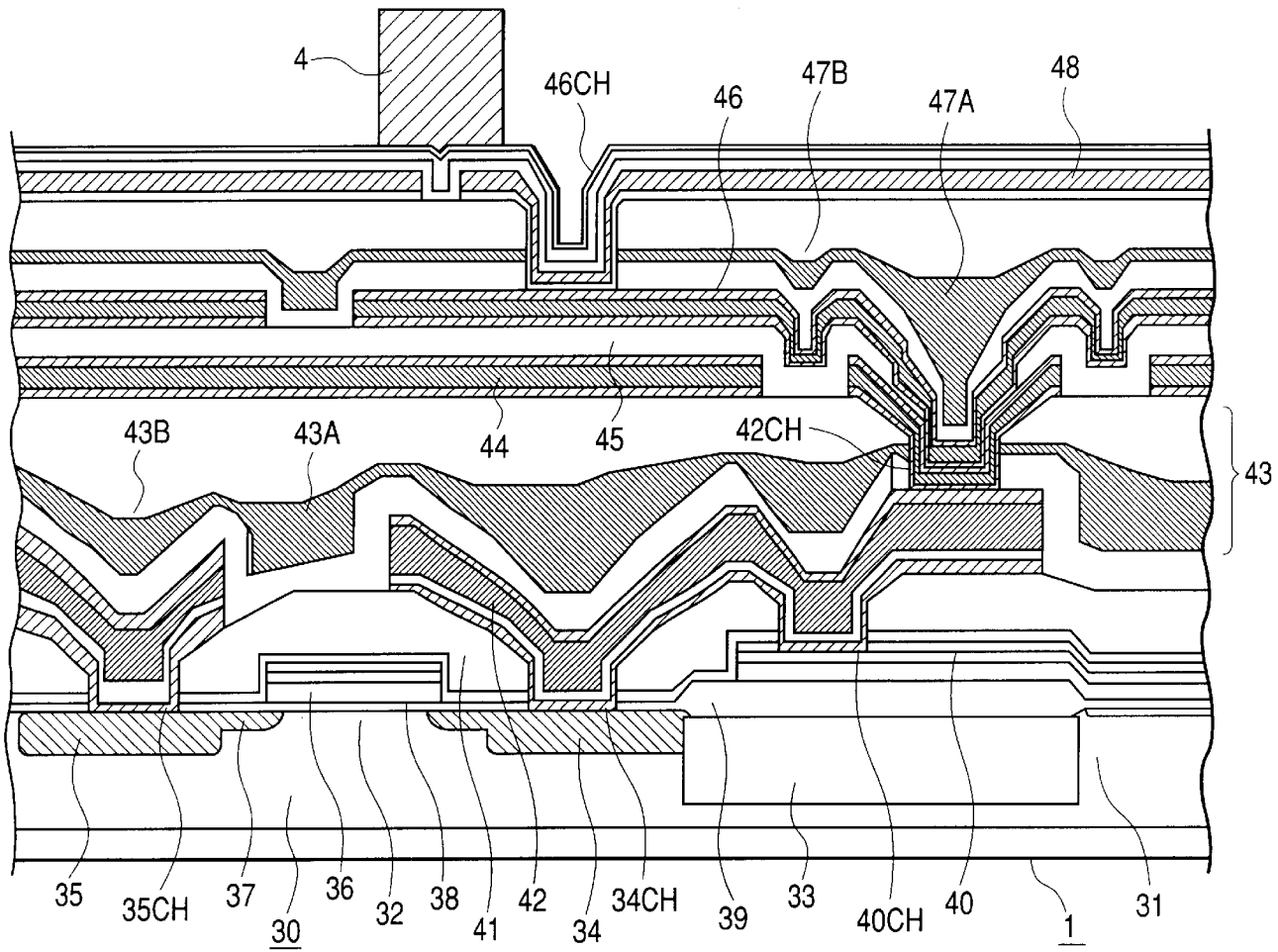
FIG. 21 is a schematic cross-sectional view of an active element and its vicinity in the liquid crystal display device in accordance with an embodiment of the present invention taken along line XXI—XXI of FIG. 21.
Figure 22:
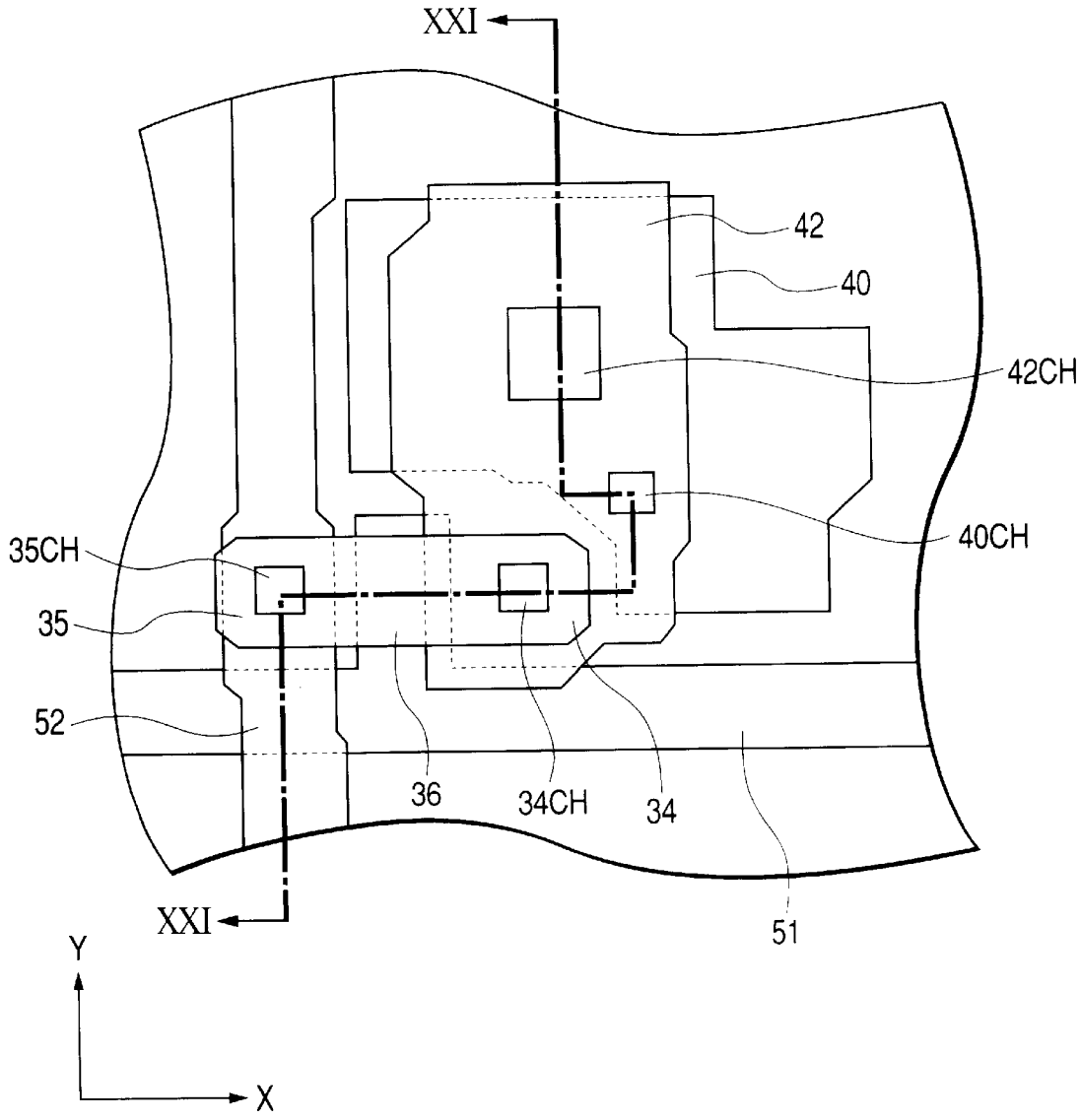
FIG. 22 is a schematic plan view of an active element and its vicinity in the liquid crystal display device in accordance with an embodiment of the present invention.

The following explains a configuration of the active elements 30 and their vicinity fabricated on the drive circuit substrate 1 by reference to FIGS. 21 and 22. The same reference numerals as utilized in FIG. 18 designate corresponding portions in FIGS. 21 and 22. FIG. 22 is a schematic plan view of the active element 30 and its vicinity, and FIG. 21 is a cross-sectional view of FIG. 22 taken along line XXI—XXI. For clarity, distances between components in FIG. 21 are not made equal to corresponding ones in FIG. 22, and FIG. 22 is intended to illustrate positional relationships among the scanning signal lines 51, the gate electrode 36, the video signal line 52, the drain region 35, the source region 34, the storage-capacitance-forming electrode 40, the first conductive layer 42, and contact holes 35CH, 34CH, 40CH and 42CH with the other components being omitted. In FIG. 21, reference numeral 31 denotes a silicon substrate serving as the drive circuit substrate, 32 is a semiconductor region (an n-type well) fabricated in the drive circuit substrate 31 by using ion implantation, 33 is a channel stopper, 34 is the source region fabricated in the n-type well 32 by being made electrically conductive by ion implantation, and 35 is the drain region fabricated in the n-type well 32 by being made electrically conductive by ion implantation. Incidentally, the source and drain designations depend upon the polarity of a bias voltage between them, but the polarity of the voltage is reversed periodically during operation in the liquid crystal display panel, and therefore the drain and source regions interchange during operation. In this specification, as a matter of convenience, one of the two regions is designated the drain region and the other is designated the source region regardless of the polarity of the bias voltage at all times.

In FIG. 21, reference numeral 36 denotes the gate electrode, 37 is an offset region for relaxing electric fields at the edge of the gate electrode 36, 38 is an insulating film, 39 is the field oxide film for electrically insulating the transistors from each other, and 40 is the storage-capacitance-forming electrode for forming a capacitance in cooperation with the silicon substrate 31 with the insulating film 38 therebetween. The gate electrode 36 and the storage-capacitance-forming electrode 40 are made of a two-layer film formed of a conductive film for lowering a threshold voltage of the active element 30 and a conductive film disposed on the insulating film 38. The two-layer film can be made of two poly-silicon and tungsten silicide films, for example. Reference numeral 41 is the first insulating interlayer film, and 42 is the first conductive film. The first conductive film 42 is a multilayer film made of a barrier metal film for preventing imperfect contact and a low-resistance conductive film. For example, a sputtered multilayer metal film made of titanium tungsten (TiW) and aluminum can be used as the first conductive film.

In FIG. 22, reference numeral 51 denotes the scanning signal line. The scanning signal lines 51 extend in the X direction in FIG. 22, are arranged in the Y direction, and are supplied with scanning signals for turning the active elements 30 ON and OFF. The scanning signal lines 51 are formed of the same two-layer film as the gate electrodes 36. The two-layer film made of laminated poly-silicon and tungsten silicide films, for example, can be used as the scanning signal lines 51. The video signal lines 52 extend in the Y direction, are arranged in the X direction, and are supplied with video signals to be written into the reflective electrodes 5. The video signal lines 52 are formed of the same multilayer metal film as the first conductive film 42. The multilayer metal film made of titanium tungsten (TiW) and aluminum, for example, can be used as the video signal lines 52.

The video signals are supplied to the drain region 35 by the first conductive film 42 through the contact hole 35CH made in the insulating film 38 and the first insulating interlayer film 41. When a scanning signal is supplied to the scanning signal line 51, the active element 30 is turned ON, and the video signal is transmitted from the semiconductor region (the n-type well) 32 to the source region 34, and then is transmitted to the first conductive film 42 through the contact hole 34CH. Thereafter the video signal is transmitted from the first conductive film 42 to the storage-capacitance-forming electrode 40 through the contact hole 40CH, and then is transmitted to the reflective electrode 5 through the contact hole 42CH as shown in FIG. 21. The contact hole 42CH is positioned over the field oxide film 39. The top surface of the field oxide film 39 is situated at a higher level than other elements because of the large thickness of the field oxide film 39. By placing the contact hole 42CH over the field oxide film 39, the contact hole 42CH can be located nearer to the upper conductive layer, and thereby the length of electrical connection at the contact hole 42CH can be shortened.

The second insulating interlayer film 43 insulates the second conductive film 44 from the first conductive film 42. The second insulating interlayer film 43 is formed of two layers composed of a planarizing film 43A for filling indentations and reducing unevenness caused by underlying elements and an insulating film 43B overlying the planarizing film 43A. The planarizing film 43A is fabricated by applying SOG (Spin-On-Glass), and the insulating film 43B is an $SiO_2$ film fabricated by a CVD process using TEOS (Tetraethylorthosilicate) as reactive gas. The second insulating interlayer film 43 is planarized by polishing it using the CMP (Chemical Mechanical Polishing) process after it is applied on the silicon substrate 31. The first light-blocking film 44 is fabricated on the planarized second insulating interlayer film. The first light-blocking film 44 is formed of the same multilayer metal film made of titanium tungsten (TiW) and aluminum as the first conductive film 42.

The first light-blocking film 44 covers the approximately entire area of the drive circuit substrate 1, and openings are made only at the contact holes 42CH shown in FIG. 21. The third insulating interlayer film 45 is fabricated on the first light-blocking film 44, by the CVD process using TEOS (Tetraethylorthosilicate) as reactive gas. Further, the second light-blocking film 46 is formed on the third insulating interlayer film 45, and is formed of the same multilayer metal film made of titanium tungsten (TiW) and aluminum as the first conductive film 42. The second light-blocking film 46 is connected to the first conductive film 42 via the contact hole 42CH. In the contact hole 42CH, the metal film forming the first light-blocking film 44 and the metal film forming the second light-blocking film 46 are laminated for electrical connection.

When the first light-blocking film 44 and the second light-blocking film 46 are made of metal films, the third interlayer film 45 made of an insulating (dielectric) film is interposed therebetween, and a voltage is applied to the first light-blocking film 44, a storage capacitance can be formed between the first light-blocking film 44 and the second light-blocking film 46. In view of the withstand voltage of the third insulating interlayer film 45 with respect to drive voltage and increasing of the capacitance by reducing the thickness of the dielectric film 45, it is desired that the thickness of the third insulating interlayer film 45 is in a range of from 150 nm to 450 nm, and is preferably about 300 nm.

Figure 23:
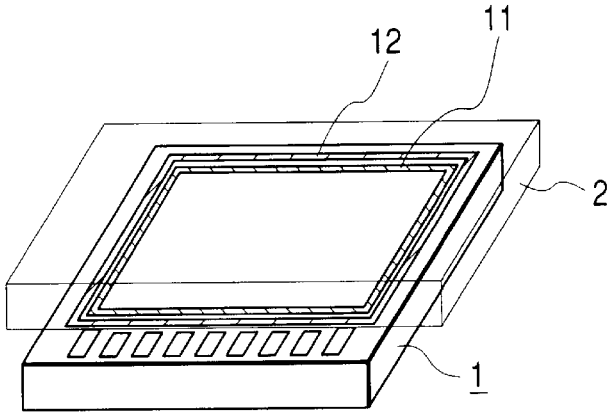
FIG. 23 is a schematic perspective view of a drive circuit substrate superposed with a transparent substrate in the liquid crystal display device in accordance with an embodiment of the present invention.

FIG. 23 is a perspective view of the drive circuit substrate 1 superposed with the transparent substrate 2. Formed at the periphery of the drive circuit substrate 1 is the peripheral frame 11, and the liquid crystal composition 3 is confined in a space surrounded by the peripheral frame 11, the drive circuit substrate 1 and the transparent substrate 2. The sealing member 12 is coated around the outside of the peripheral frame 11 between the superposed drive circuit substrate 1 and transparent substrate 2. The drive circuit substrate 1 and the transparent substrate 2 are fixed together by the sealing member 12 to form the liquid crystal display panel 100.

Figure 24:
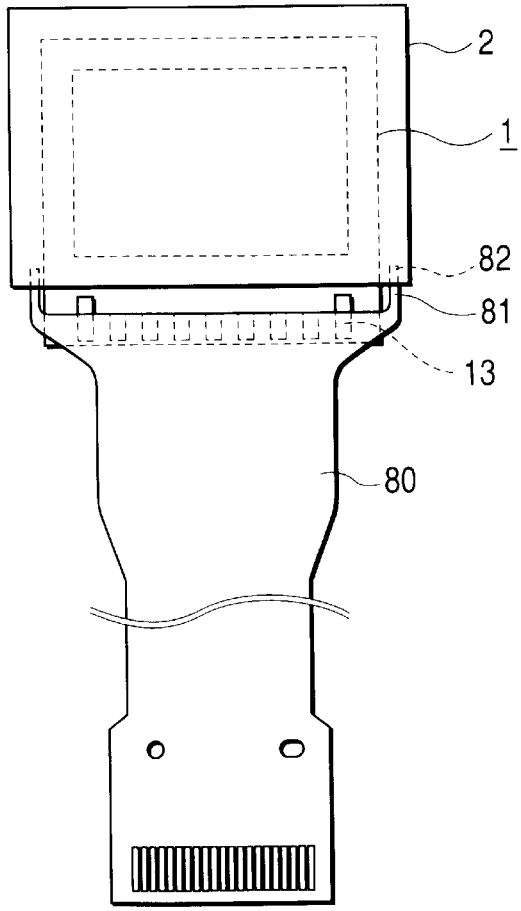
FIG. 24 is a schematic plan view of a liquid crystal display panel having a flexible printed circuit board coupled thereto in the liquid crystal display device in accordance with an embodiment of the present invention.

Next, as shown in FIG. 24, a flexible printed wiring board 80 for supplying external signals to the liquid crystal display panel 100 is connected to terminals 13 for external connections. Two outermost terminals on opposite sides of one end of the flexible printed wiring board 80 are made longer than the remainder of terminals, are connected to the counter electrode 5 formed on the transparent substrate 2, and thereby serve as counter-electrode terminals 81. In this way, the flexible printed wiring board 80 is connected to both of the drive circuit substrate 1 and the transparent substrate 2.

Conventionally, a flexible printed wiring board is connected to terminals for external connections disposed on the drive circuit substrate 1 only, and therefore the wiring to the counter electrode 5 from the flexible printed wiring board is made via the drive circuit substrate 1.

The transparent substrate 2 in this embodiment of the present invention is provided with connecting portions 82 to be connected to the flexible printed wiring board 80 such that the flexible printed wiring board 80 is connected directly to the counter electrode 5. The liquid crystal display panel 100 is formed by superposing the transparent substrate 2 on the drive circuit substrate 1. The transparent substrate 2 is superposed on the drive circuit substrate 1 such that a peripheral portion of the transparent substrate 2 extends beyond the outside edges of the drive circuit substrate 1 and provides the connecting portions 82 where the flexible printed wiring board 80 is connected to the counter electrode 5.

Figure 25:
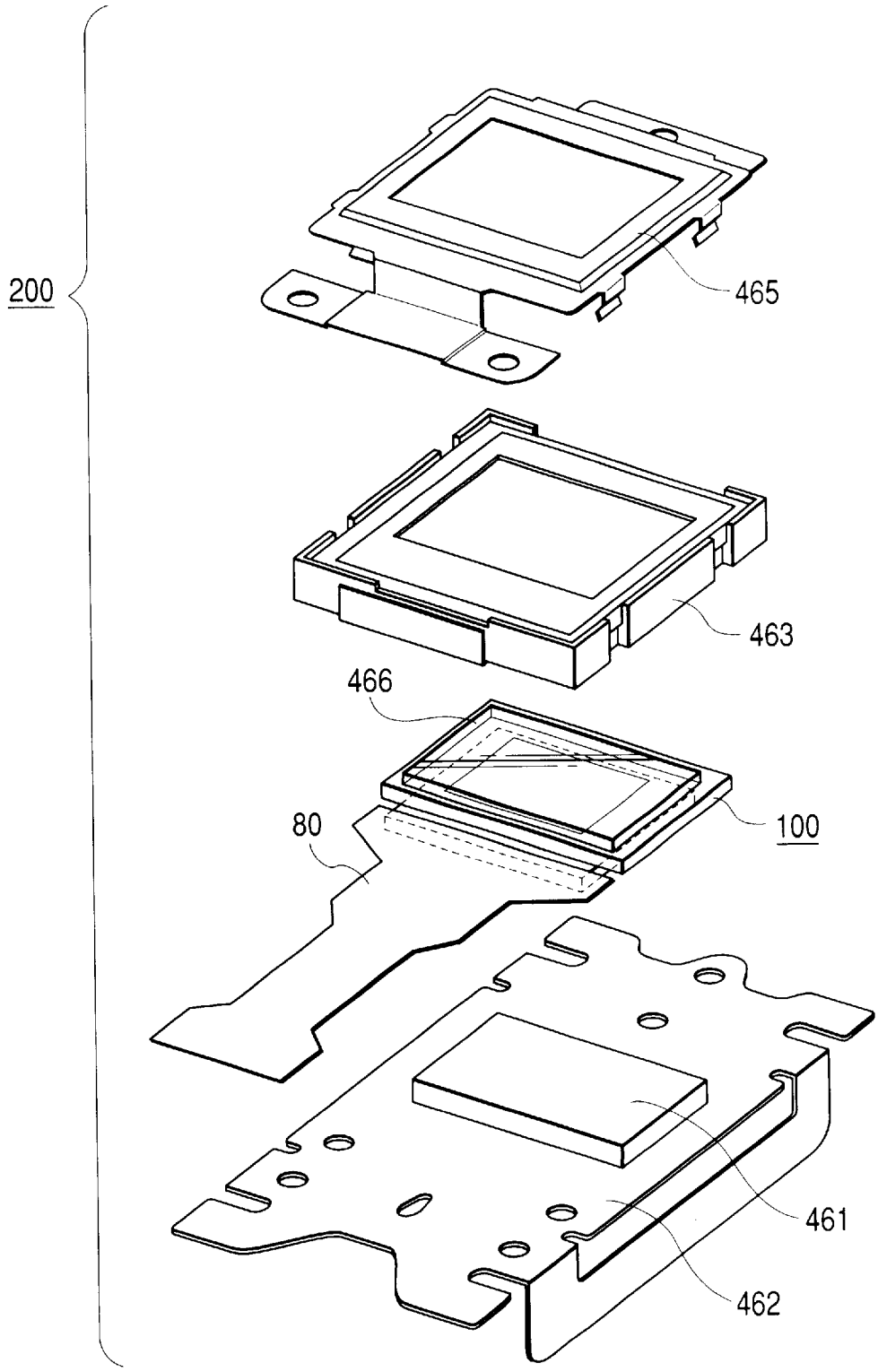
FIG. 25 is a schematic exploded view in perspective of major elements of the liquid crystal display device in accordance with an embodiment of the present invention.
Figure 26:
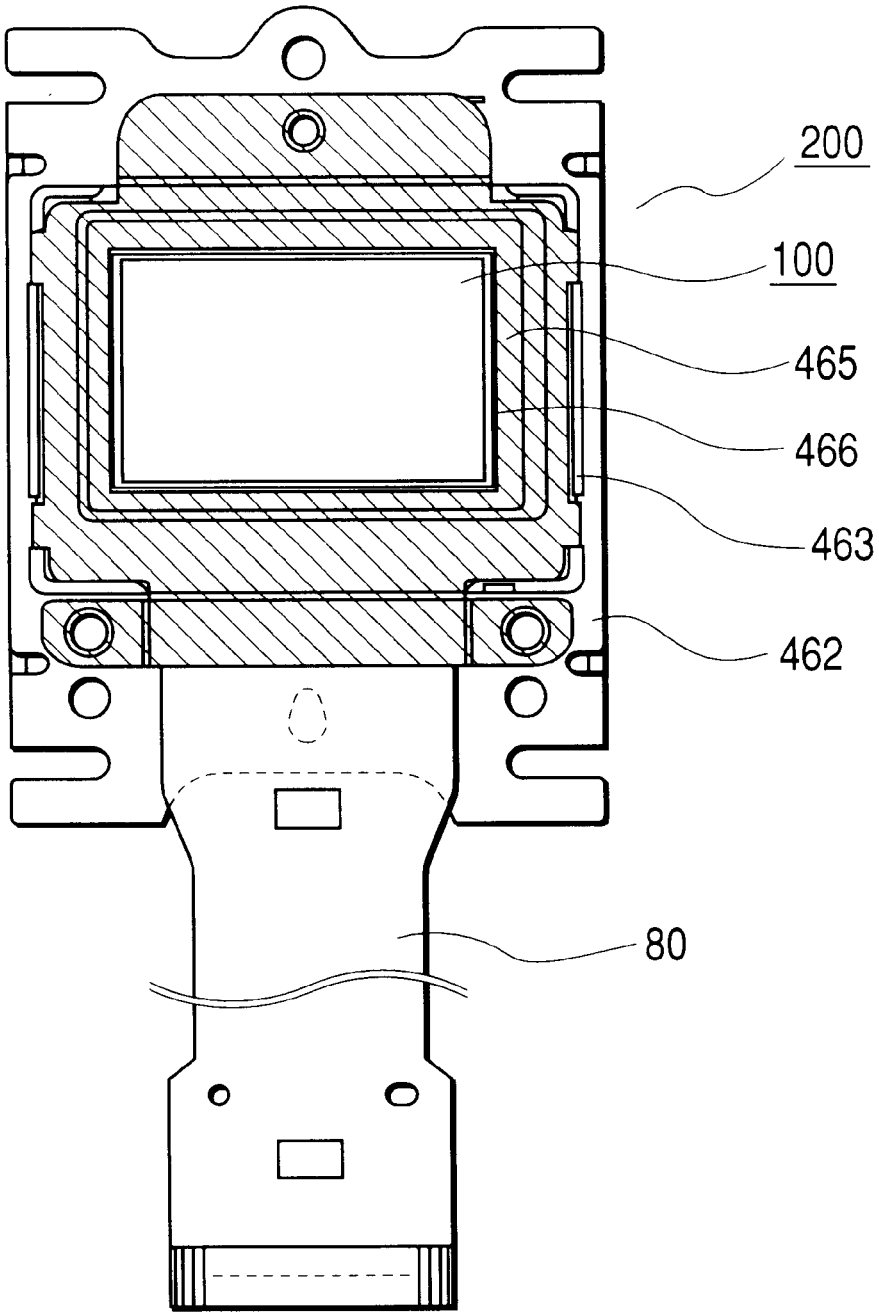
FIG. 26 is a schematic plan view of the liquid crystal display device accordance with an embodiment of the present invention.

FIGS. 25 and 26 illustrate a configuration of the liquid crystal display device 200. FIG. 25 is an exploded view in perspective of the major elements of the liquid crystal display device 200, and FIG. 26 is a plan view of the liquid crystal display device 200.

As shown in FIG. 25, the liquid crystal display panel 100 having the flexible printed wiring board 80 connected thereto is disposed on the heat-radiating plate 462 with a cushion member 461 interposed therebetween. The cushion member 461 is highly heat-conductive, and fills a gap between the heat-radiating plate 462 and the liquid crystal display panel 100 for heat from the liquid crystal display panel 100 to conduct to the heat-radiating plate 462 easily. Reference numeral 463 denotes a mold, which is fixed to the heat-radiating plate 462 with an adhesive.

As shown in FIG. 26, the flexible printed wiring board 80 is passed between the mold 463 and the heat-radiating plate 462, and then is brought out of the mold 463. Reference numeral 465 denotes a light-blocking plate which prevents light from a light source from entering the unintended portions of the liquid crystal display device 200, and 466 is a light-blocking frame which defines the display area of the liquid crystal display device 200.

The invention by the present inventors has been explained concretely based upon the embodiments in accordance with the present invention, but the present invention is not limited to the above-described embodiments, and various changes and modifications can be made without departing from the spirit and scope of the present invention.

The advantages obtained by the representative ones of the inventions disclosed in this specification can be summarized as follows:

The present invention makes possible reduction of a space occupied by the horizontal drive circuit incorporated into the liquid crystal display panel, and is also capable of miniaturizing the liquid crystal display panel.

What is claimed is:

1. A liquid crystal display device comprising a first substrate, a second substrate, a liquid crystal composition sandwiched between said first substrate and said second substrate, a plurality of pixels disposed on said first substrate, a plurality of video signal lines for supplying video signal voltages to said plurality of pixels, a drive circuit adapted to be supplied with a gray-scale voltage varying periodically for outputting said video signal voltages to said plurality of video signal lines, N display data lines for supplying display data to said drive circuit, and N time control signal lines for supplying time control signals varying in synchronism with said gray-scale voltage to said drive circuit, wherein said drive circuit is provided with a voltage selector circuit for selecting voltage levels from said gray-scale voltage based upon said display data and outputting said voltage levels to said plurality of video signal lines;

said voltage selector circuit includes a plurality of series combinations of processing circuits, each of said plurality of series combinations being associated with one of said plurality of video signal lines, each of said processing circuits of a respective one of said plurality of series combinations being associated both with a respective one of said N display data lines and with a respective one of said N time control signal lines, and being disposed between two adjacent ones of said N display data lines, each of said processing circuits comprises a parallel combination of a display-data-related switching element and a time-control-signal-related switching element, said display data make $2^N$ different combinations by selecting a number of from zero to N of said display-data-related switching elements, assigning said selected number of said display-data-related switching elements to be turned OFF and turning ON the remainder of said display-data-related switching elements in each of said plurality of series combinations, each of said $2^N$ different combinations being uniquely in synchronism with one level of said gray-scale voltage, said time control signals uniquely determine one level of said gray-scale voltage by turning ON a time-control-signal-related switching element constituting said parallel combination with said turned-OFF display-data-related switching element.

2. A liquid crystal display device according to claim 1, wherein said display-data-related switching element and said time-control-signal-related switching element are formed of transistors of a same conductivity type.

3. A liquid crystal display device according to claim 1, wherein said first substrate is made of silicon.

4. A liquid crystal display device according to claim 1, wherein said gray-scale voltage varies in a staircase fashion.

5. A liquid crystal display device according to claim 1, wherein each of said N display data lines is supplied with a respective one of N bits representing said display data in a binary system.

6. A liquid crystal display device according to claim 1, wherein each of said processing circuits is disposed between two adjacent ones of said plurality of video signal lines.

7. A liquid crystal display device comprising:

a first substrate, a second substrate, a liquid crystal composition sandwiched between said first substrate and said second substrate, a plurality of pixels arranged in a matrix array on said first substrate, a plurality of video signal lines extending in a column direction and arranged in a row direction of said matrix array for supplying video signal voltages to said plurality of pixels, a drive circuit adapted to be supplied with a gray-scale voltage varying periodically for outputting said video signal voltages to said plurality of video signal lines, N display data lines extending in said row direction and arranged in said column direction for supplying display data to said drive circuit, and N time control signal lines extending in said row direction and arranged in said column direction for supplying time control signals varying in synchronism with said gray-scale voltage to said drive circuit;

wherein said drive circuit includes a voltage selector circuit for selecting voltage levels from said gray-scale voltage based upon said display data and outputting said voltage levels to said plurality of video signal lines, a shift register for supplying timing signals to said voltage selector circuit, and a plurality of timing signal lines for supplying said timing signals from said shift register to said voltage selector circuit;

said voltage selector circuit includes a plurality of series combinations of processing circuits, and a plurality of data taking-in elements for taking in said display data in synchronism with said timing signals, each of said plurality of data taking-in elements corresponding to a respective one of said processing circuits and disposed together with said respective one of said processing circuits between two adjacent ones of said N display data lines, said plurality of timing signal lines are extending from said shift register in said column direction, connected to corresponding ones of said data taking-in elements, and are made of a conductive film of a same level as that of conductive films forming control electrodes of said data taking-in elements, each of said plurality of series combinations being associated with one of said plurality of video signal lines, each of said processing circuits of a respective one of said plurality of series combinations being associated both with a respective one of said N display data lines and a respective one of said N time control signal lines, each of said processing circuits comprises a parallel combination of a display-data-related switching element and a time-control-signal-related switching element, said display data make $2^N$ different combinations by selecting a number of from zero to N of said display-data-related switching elements, assigning said selected number of said display-data-related switching elements to be turned OFF and turning ON the remainder of said display-data-related switching elements in each of said plurality of series combinations, each of said $2^N$ different combinations being uniquely in synchronism with one level of said gray-scale voltage, said time control signals uniquely determine one level of said gray-scale voltage by turning ON a time-control-signal-related switching elements constituting said parallel combination with said turned-OFF display-data-related switching element.

8. A liquid crystal display device according to claim 7, wherein said display-data-related switching element and said time-control-signal-related switching element are formed of transistors of a same conductivity type.

9. A liquid crystal display device according to claim 7, wherein said first substrate is made of silicon.

10. A liquid crystal display device according to claim 7, wherein said gray-scale voltage varies in a staircase fashion.

11. A liquid crystal display device according to claim 7, wherein each of said N display data lines is supplied with a respective one of N bits representing said display data in a binary system.

12. A liquid crystal display device according to claim 7, wherein each of said processing circuits is disposed between two adjacent ones of said plurality of video signal lines.

13. A liquid crystal display device comprising:

a first substrate, a second substrate, a liquid crystal composition sandwiched between said first substrate and said second substrate, a plurality of pixels disposed on said first substrate, a plurality of video signal lines for supplying video signal voltages to said plurality of pixels, a drive circuit adapted to be supplied with a gray-scale voltage varying periodically for outputting said video signal voltages to said plurality of video signal lines, N display data lines for supplying display data to said drive circuit, and N time control signal lines for supplying time control signals varying in synchronism with said gray-scale voltage to said drive circuit;

wherein said drive circuit is provided with a voltage selector circuit for selecting voltage levels from said gray-scale voltage based upon said display data and outputting said voltage levels to said plurality of video signal lines;

said voltage selector circuit includes a plurality of series combinations of processing circuits, and a plurality of output circuits for outputting said voltage levels to said plurality of video signal lines based upon an output from said plurality of said series combinations, each of said plurality of output circuits being connected in series with a corresponding one of said plurality of series combinations, each of said plurality of series combinations being associated with one of said plurality of video signal lines, each of said processing circuits of a respective one of said plurality of series combinations being associated both with a respective one of said N display data lines and with a respective one of said N time control signal lines, and disposed between two adjacent ones of said N display data lines, each of said processing circuits comprises a parallel combination of a display-data-related switching element and a time-control-signal-related switching element coupled together to form an OR circuit, said display data make $2^N$ different combinations by selecting a number of from zero to N of said display-data-related switching elements, assigning said selected number of said display-data-related switching elements to be turned OFF and turning ON the remainder of said display-data-related switching elements in each of said plurality of series combinations, each of said $2^N$ different combinations being uniquely in synchronized with one level of said gray-scale voltage, and each of said plurality of output circuits is supplied with a control signal for uniquely determining one level of said gray-scale voltage corresponding to said display data when all of said processing circuits of a corresponding one of said plurality of series combinations are turned ON.

14. A liquid crystal display device according to claim 13, wherein said display-data-related switching element and said time-control-signal-related switching element are formed of transistors of a same conductivity type.

15. A liquid crystal display device according to claim 13, wherein said first substrate is made of silicon.

16. A liquid crystal display device according to claim 13, wherein said gray-scale voltage varies in a staircase fashion.

17. A liquid crystal display device according to claim 13, wherein each of said N display data lines is supplied with a respective one of N bits representing said display data in a binary system.

18. A liquid crystal display device according to claim 13, wherein each of said processing circuits is disposed between two adjacent ones of said plurality of video signal lines.

19. A liquid crystal display device comprising:

a first substrate, a second substrate, a liquid crystal composition sandwiched between said first substrate and said second substrate, a plurality of pixels disposed on said first substrate, a plurality of video signal lines for supplying video signal voltages to said plurality of pixels, a drive circuit adapted to be supplied with a gray-scale voltage varying periodically for outputting said video signal voltages to said plurality of video signal lines, N display data lines for supplying display data to said drive circuit, and N time control signal lines for supplying time control signals varying in synchronism with said gray-scale voltage to said drive circuit, wherein said drive circuit is provided with a voltage selector circuit for selecting voltage levels from said gray-scale voltage based upon said display data and outputting said voltage levels to said plurality of video signal lines;

said voltage selector circuit includes a plurality of series combinations of processing circuits, each of said plurality of series combinations being associated with one of said plurality of video signal lines, each of said processing circuits of a respective one of said plurality of series combinations being associated both with a respective one of said N display data lines and with a respective one of said N time control signal lines, and being disposed between two adjacent ones of said N display data lines, each of said processing circuits comprises a parallel combination of a display-data-related switching element and a time-control-signal-related switching element, said time control signals make $2^N$ different combinations by selecting a number of from zero to N of said time-control-signal-related switching elements, assigning said selected number of said time-control-signal-related switching elements to be turned OFF and turning ON the remainder of said time-control-signal-related switching elements in each of said plurality of series combinations, each of said $2^N$ different combinations being uniquely in synchronism with one level of said gray-scale voltage, said display data uniquely determine one level of said gray-scale voltage by turning ON a display-data-related switching element constituting said parallel combination with said turned-OFF time-control-signal-related switching element.

20. A liquid crystal display device comprising:

a first substrate, a second substrate, a liquid crystal composition sandwiched between said first substrate and said second substrate, a plurality of pixels arranged in a matrix array on said first substrate, a plurality of video signal lines extending in a column direction and arranged in a row direction of said matrix array for supplying video signal voltages to said plurality of pixels, a drive circuit adapted to be supplied with a gray-scale voltage varying periodically for outputting said video signal voltages to said plurality of video signal lines, N display data lines extending in said row direction and arranged in said column direction for supplying display data to said drive circuit, and N time control signal lines extending in said row direction and arranged in said column direction for supplying time control signals varying in synchronism with said gray-scale voltage to said drive circuit;

wherein said drive circuit includes a voltage selector circuit for selecting voltage levels from said gray-scale voltage based upon said display data and outputting said voltage levels to said plurality of video signal lines, a shift register for supplying timing signals to said voltage selector circuit, and a plurality of timing signal lines for supplying said timing signals from said shift register to said voltage selector circuit;

said voltage selector circuit includes a plurality of series combinations of processing circuits, and a plurality of data taking-in elements for taking in said video signal in synchronism with said timing signals, each of said plurality of data taking-in elements corresponding to a respective one of said processing circuits and disposed together with said respective one of said processing circuits between two adjacent ones of said N display data lines, said plurality of timing signal lines are extending from said shift register in said column direction, connected to corresponding ones of said data taking-in elements, and are made of a conductive film of a same level as that of conductive films forming control electrodes of said data taking-in elements, each of said plurality of series combinations being associated with one of said plurality of video signal lines, each of said processing circuits of a respective one of said plurality of series combinations being associated both with a respective one of said N display data lines and a respective one of said N time control signal lines, each of said processing circuits comprises a parallel combination of a display-data-related switching element and a time-control-signal-related switching element, said time control signals make $2^N$ different combinations by selecting a number of from zero to N of said time-control-signal-related switching elements, assigning said selected number of said time-control-signal-related switching elements to be turned OFF and turning ON the remainder of said time-control-signal-related switching elements in each of said plurality of series combinations, each of said $2^N$ different combinations being uniquely in synchronism with one level of said gray-scale voltage, said display data uniquely determine one level of said gray-scale voltage by turning ON a display-data-related switching elements constituting a parallel combination with said turned-OFF time-control-signal-related switching element.

21. A liquid crystal display device comprising:

a first substrate, a second substrate, a liquid crystal composition sandwiched between said first substrate and said second substrate, a plurality of pixels disposed on said first substrate, a plurality of video signal lines for supplying video signal voltages to said plurality of pixels, a drive circuit adapted to be supplied with a gray-scale voltage varying periodically for outputting said video signal voltages to said plurality of video signal lines, N display data lines for supplying display data to said drive circuit, and N time control signal lines for supplying time control signals varying in synchronism with said gray-scale voltage to said drive circuit;

wherein said drive circuit is provided with a voltage selector circuit for selecting voltage levels from said gray-scale voltage based upon said display data and outputting said voltage levels to said plurality of video signal lines;

said voltage selector circuit includes a plurality of series combinations of processing circuits, and a plurality of output circuits for outputting said voltage levels to said plurality of video signal lines based upon an output from said plurality of said series combinations, each of said plurality of output circuits being connected in series with a corresponding one of said plurality of series combinations, each of said plurality of series combinations being associated with one of said plurality of video signal lines, each of said processing circuits of a respective one of said plurality of series combinations being associated both with a respective one of said N display data lines and with a respective one of said N time control signal lines, and disposed between two adjacent ones of said N display data lines, each of said processing circuits comprises a parallel combination of a display-data-related switching element and a time-control-signal-related switching element coupled together to form an OR circuit, said time control signals make $2^N$ different combinations by selecting a number of from zero to N of said time-control-signal-related switching elements, assigning said selected number of said time-control-signal-related switching elements to be turned OFF and turning ON the remainder of said time-control-signal-related switching elements in each of said plurality of series combinations, each of said $2^N$ different combinations being uniquely in synchronized with one level of said gray-scale voltage, and each of said plurality of output circuits is supplied with a control for uniquely determining one level of said gray-scale voltage corresponding to said display date when all of said processing circuits of a corresponding one of said plurality of series combinations are turned ON.

* * * * *